US012215396B2

(12) United States Patent
Yamanaka et al.

(10) Patent No.: US 12,215,396 B2
(45) Date of Patent: Feb. 4, 2025

(54) IRON-BASED ALLOY AND METHOD OF MANUFACTURING THE SAME

(71) Applicant: TOHOKU UNIVERSITY, Sendai (JP)

(72) Inventors: Kenta Yamanaka, Sendai (JP); Akihiko Chiba, Sendai (JP)

(73) Assignee: TOHOKU UNIVERSITY, Sendai (JP)

( * ) Notice: Subject to any disclaimer, the term of this patent is extended or adjusted under 35 U.S.C. 154(b) by 231 days.

(21) Appl. No.: 17/272,881

(22) PCT Filed: Sep. 2, 2019

(86) PCT No.: PCT/JP2019/034481
§ 371 (c)(1),
(2) Date: Mar. 2, 2021

(87) PCT Pub. No.: WO2020/050229
PCT Pub. Date: Mar. 12, 2020

(65) Prior Publication Data

US 2021/0317541 A1 Oct. 14, 2021

(30) Foreign Application Priority Data

Sep. 4, 2018 (JP) ..... 2018-165465

(51) Int. Cl.

| | |
|---|---|
| ***C21D 6/00*** | (2006.01) |
| ***C22C 33/08*** | (2006.01) |
| ***C22C 37/08*** | (2006.01) |
| ***C22C 38/22*** | (2006.01) |
| ***C22C 38/44*** | (2006.01) |

(52) U.S. Cl.
CPC ..... *C21D 6/004* (2013.01); *C22C 33/08* (2013.01); *C22C 37/08* (2013.01); *C22C 38/22* (2013.01); *C22C 38/44* (2013.01); *C21D 2211/008* (2013.01)

(58) Field of Classification Search
CPC ..... C21D 6/004
See application file for complete search history.

(56) References Cited

U.S. PATENT DOCUMENTS

2005/0236072 A1* 10/2005 Takayama ..... C22C 38/04 148/334
2010/0108199 A1 5/2010 Takayama

FOREIGN PATENT DOCUMENTS

| | | | |
|---|---|---|---|
| EP | 1 736 563 | A1 | 12/2006 |
| JP | S56-003681 | A | 1/1981 |
| JP | S56-042665 | A | 4/1981 |
| JP | S57-126956 | A | 8/1982 |
| JP | H01-272745 | A | 10/1989 |
| JP | 2005-330581 | A | 12/2005 |
| JP | 4952888 | B2 | 6/2012 |
| JP | 2017-512253 | A | 5/2017 |
| JP | 2017-166066 | A | 9/2017 |
| WO | 03/069009 | A1 | 8/2003 |

OTHER PUBLICATIONS

Oct. 22, 2021 Extended Search Report issued in European Patent Application No. 19857077.2.
Cong, Zhenhua et al., "Dislocation Density of Lath Martensite In 10Cr-5W Heat-Resistant Steels", Materials Transactions, vol. 52, No. 12, (2011), pp. 2151-2154.
Gubicza, Jenõ et al., "Microstructure, Phase Composition and Hardness Evolution in 316L Stainless Steel Processed by High-Pressure Torsion", Materials Sciene & Engineering A, vol. 657, (2016), pp. 215-223.
Oct. 21, 2019 Search Report issued in International Patent Application No. PCT/JP2019/034481.
Aug. 28, 2020 International Preliminary Report on Patentability issued in International Patent Application No. PCT/JP2019/034481.

* cited by examiner

*Primary Examiner* — Christopher S Kessler
(74) *Attorney, Agent, or Firm* — Oliff PLC

(57) ABSTRACT

An iron-based alloy has excellent corrosion resistance and high strength and a method of manufacturing the iron-based alloy. The iron-based alloy includes Cr: 10 to 22 mass %, W: 1 to 12 mass %, and C: 0.1 to 2.3 mass %, with the remainder being unavoidable impurities and Fe, and is composed of a cast material having a structure composed mainly of austenite or a quenched material having a structure composed mainly of martensite and in which carbides are precipitated. The iron-based alloy may further include Cu: 0.5 to 6 mass % and/or Ni: 0.5 to 2.5 mass %, and may further include at least one of Al, Mo, and Si in an amount of 1 to 3 mass %.

9 Claims, 18 Drawing Sheets

IRON-BASED ALLOY AND METHOD OF MANUFACTURING THE SAME

FIELD OF THE INVENTION

The present invention relates to an iron-based alloy and a method of manufacturing the iron-based alloy.

DESCRIPTION OF RELATED ART

On the resin market, super engineering plastics, which have excellent strength and thermal resistance, are expanding their markets rapidly in the automobile and electronics industries, and others. In particular, automobile manufacturers are working on trimming auto weights to achieve reduced $CO_2$ emissions (improved fuel efficiency). To this end, they are actively promoting the replacement of steel materials, which are thought to be accountable for 60 to 70% of an auto weight. The most promising approach to this is to resinify parts. Highly-functional super engineering plastics having excellent thermal resistance or durability are also used ubiquitously in the course of "car electronization" for the purpose of improving comfort and safety.

Super engineering plastics may include those types such as polyamide 11 and 12 (PA11 and 12) resin, polyphenylene sulfide (PPS) resin, and fluorine resin. They are selected according to the requirements for the environments where they are used, such as strength, operating temperature, and chemical resistance. Among the super engineering plastic resins used in the automobile field, PPS resin is used most often after PA11 and PA12, and adopted for applications such ignition coil casings, headlamp reflectors, and fuel pump impellers. Further, as PPS resin is also excellent in thermal resistance/heat check resistance/chemical resistance, recently there has been increasing demand for electrical components such as sensors and ECU cases. Among the super engineering plastic resins used in the electric and electronic fields, PPS resin is also the most in demand globally due to its excellent precision moldability/fire retardancy, and is used for microswitches, optical pickups of CD drives, and others. Meanwhile, in our country, where the automobile and electronics industries are prosperous, PPS resin is more in demand than PA11 and PA12, and has been constantly ranked as the most in demand.

PPS resin has high added value and is expected to rapidly expand its global and domestic markets as described above. In the molding process of PPS resin, however, the service life of the parts of the molding machines is the greatest concern. In PPS resin, corrosive "sulfurous acid gas ($SO_2$)" may be generated during plasticizing and melting. Therefore, equipment members need to be developed which can withstand such harsh usage environments. Serious abrasion may also occur due to a hard filler (glass fiber: GF) added for improving the strength of the parts. For this reason, a metal part which will be in contact with melted resin, such as a plasticizing apparatus for molding and a mold, may seriously suffer from corrosive wear, soon resulting in poor plasticization, poor filling, defects in shape, and the like. In recent years, these risks have become increasingly serious because the filling factor of fillers is continuing to increase.

In order to solve the above problems, Fe—Cr based alloys (SKD11, SUS420J2, SUS440C, and others), which have relatively good corrosion resistance and can be hardened by quenching, hard chromium plating, or coatings of titanium nitride and others may be used in conventional plasticizing apparatuses for the molding of PPS resin. However, Fe—Cr based alloys such as SKD11 do not necessarily have sufficient corrosion resistance and abrasion resistance. Accordingly, the following measures are currently being taken: parts of a plasticizing apparatus may be replaced before defects occur, such as when a part is worn to a reference value or more as determined by periodical measuring of the dimensions of it; when surface roughness is visually detected; when the number of shots reaches a certain valve as determined based on operational experience; or the like. Further, surface treatments such as coating, which has an issue of peeling, are difficult to use for a long period of time.

Accordingly, martensitic stainless steel has been proposed for use as a material of a plasticizing apparatus and a mold for resin molding in place of Fe—Cr based alloys such as SKD11 and coatings (for example, see Patent Literature 1 to 3).

CITATION LIST

Patent Literature 1: Japanese Patent No. 4952888
Patent Literature 2: Japanese Translation of PCT International Application Publication No. 2017-512253
Patent Literature 3: Japanese Patent Application Laid-Open No. 2017-166066

SUMMARY OF THE INVENTION

However, while the martensitic stainless steels according to Patent Literature 1 to 3 can provide either corrosion resistance capable of withstanding corrosion due to sulfurous acid gas generated upon the melting of PPS resin or high strength (abrasion resistance) capable of withstanding abrasive wear due to a hard filler (glass fiber: GF), they cannot provide both simultaneously.

The present invention was made in view of the above problems. An object of the present invention is to provide an iron-based alloy having both excellent corrosion resistance and high strength and a method of manufacturing the iron-based alloy.

To achieve the above object, an iron-based alloy according to the present invention may include Cr: 10 to 22 mass %, W: 1 to 12 mass %, and C: 0.1 to 2.3 mass %, with the remainder being unavoidable impurities and Fe, and have a structure composed mainly of martensite in which $M_{23}C_6$-type carbides are precipitated, and have a dislocation density of $0.2\times10^{16}$ $m^{-2}$ or more and a Vickers hardness of HV 380 or more.

The method for manufacturing an iron-based alloy according the present invention may comprise manufacturing an iron-based alloy having a structure composed mainly of martensite and in which $M_{23}C_6$-type carbides are precipitated and having a dislocation density of $0.2\times10^{16}$m−2 or more and a Vickers hardness of HV 380 or more by heat-treatment at 600° C. to 1250° C. for 0.5 to 24 hours and subsequent rapid cooling of a material prepared by casting or a material processed after casting the composition of raw materials comprising Cr: 10 to 22 mass %, W: 1 to 12 mass %, and C: 0.1 to 2.3 mass %, with the remainder being unavoidable impurities and Fe.

The iron-based alloy according to the present invention can be suitably manufactured by the method for manufacturing an iron-based alloy according to the present invention. In the method for manufacturing an iron-based alloy according to the present invention, as the addition amount of Cr is 10 mass % to 22 mass %, the addition amount of W is 1 mass % to 12 mass %, and the addition amount of C is 0.1 mass % to 2.3 mass % in the resulting cast material by casting the composition of raw materials, a high-temperature range can be achieved where an austenite having a face-centered cubic structure is stabilized. Therefore, martensitic transformation can be induced by maintaining that high-temperature range and then quenching in iced water and the like so that quenching forms a high-hardness martensitic structure comprised of a matrix mainly having a body-centered cubic structure, and further to form carbides of the $M_{23}C_6$ type and the like. Martensitic transformation can also be induced during cooling by using a water-cooling mold as in the arc melting method and using a fast cooling rate in casting to form a high-hardness martensitic structure and carbides of the $M_{23}C_6$ type and the like. Thereby, the iron-based alloy according to the present invention, which has a structure composed mainly of martensite in which $M_{23}C_6$-type carbides are precipitated, can be manufactured. The use of martensitic transformation can provide a high-hardness matrix structure while the presence of carbides can further enhance hardness.

For the iron-based alloy according to the present invention, both a cast material and a quenched material have excellent corrosion resistance along with high strength. The iron-based alloy according to the present invention preferably has excellent corrosion resistance against, for example, sulfuric acid, hydrochloric acid, hydrofluoric acid, nitric acid, and the like depending on corrosive environments. For the iron-based alloy according to the present invention, a cast material preferably has a Vickers hardness of HV 250 or more. Moreover, the cast material may be composed of an austenite structure or a ferrite structure. When this is the case, plastic working and the like will be unlikely to cause cracks and such, and good workability can be obtained. Alternatively, the cast material may be composed of a martensitic structure. When this is the case, the cast material can be directly used without performing plastic working. Moreover, for the iron-based alloy according to the present invention, a quenched material may have a Vickers hardness of HV 400 or more. For the iron-based alloy according to the present invention, a quenched material does not necessarily have a structure consisting only of martensite and carbides, but may include, for example, a trace amount of ferrite or residual austenite depending on alloy compositions or heat treatment conditions. It is noted that the iron-based alloy according to the present invention may have decreased corrosion resistance when the addition amount of Cr is less than 10 mass %. Further, the addition amount of Cr is preferably 16 mass % or more in order to obtain superior corrosion resistance.

The iron-based alloy according to the present invention may further include Cu: 0.5 to 6 mass % and/or Ni: 0.5 to 2.5 mass %. In the method for manufacturing an iron-based alloy according to the present invention, the above composition of raw materials may further include Cu: 0.5 to 6 mass % and/or Ni: 0.5 to 2.5 mass %. In this case, the presence of Cu and/or Ni can further enhance corrosion resistance.

The iron-based alloy according to the present invention may further include at least one of Al, Mo, and Si in an amount of 1 to 3 mass %. In the method for manufacturing an iron-based alloy according to the present invention, the above composition of raw materials may further include at least one of Al, Mo, and Si in an amount of 1 to 3 mass %. In this case, the presence of Al, Mo, and/or Si can further enhance corrosion resistance and oxidation resistance.

In the method for manufacturing an iron-based alloy according to the present invention, the heat treatment temperature may be 800° C. or more and 1150° C. or less. Further, the heat treatment time may be 5 hours or less or 3 hours or less. In these cases, quenching can be efficiently performed in a short time. Further, the method for manufacturing an iron-based alloy according to the present invention may comprise performing tempering after heat treatment in order to enhance toughness or hardness.

The iron-based alloy according to the present invention can be manufactured inexpensively with common dissolving/processing equipment without using powder metallurgy technology. It can also be processed into a desired shape by hot and cold working (rolling, forging, swaging, and the like) by virtue of its excellent plastic workability. Further, working processes can eliminate solidification segregation and the like to obtain homogeneous structures/properties. Moreover, the iron-based alloy according to the present invention can be highly hardened by quenching, and thus a cast material and the like before quenching can be subjected to plastic working, machining, or the like to shape it into a desired product shape such as a screw. The iron-based alloy according to the present invention may be used for any applications where excellent corrosion resistance and high strength are required, including plasticizing apparatuses, molds, or the like, for resin molding.

The present invention can provide an iron-based alloy having excellent corrosion resistance and high strength and a method of manufacturing the iron-based alloy.

DETAILED DESCRIPTION OF THE INVENTION

Figure 1:
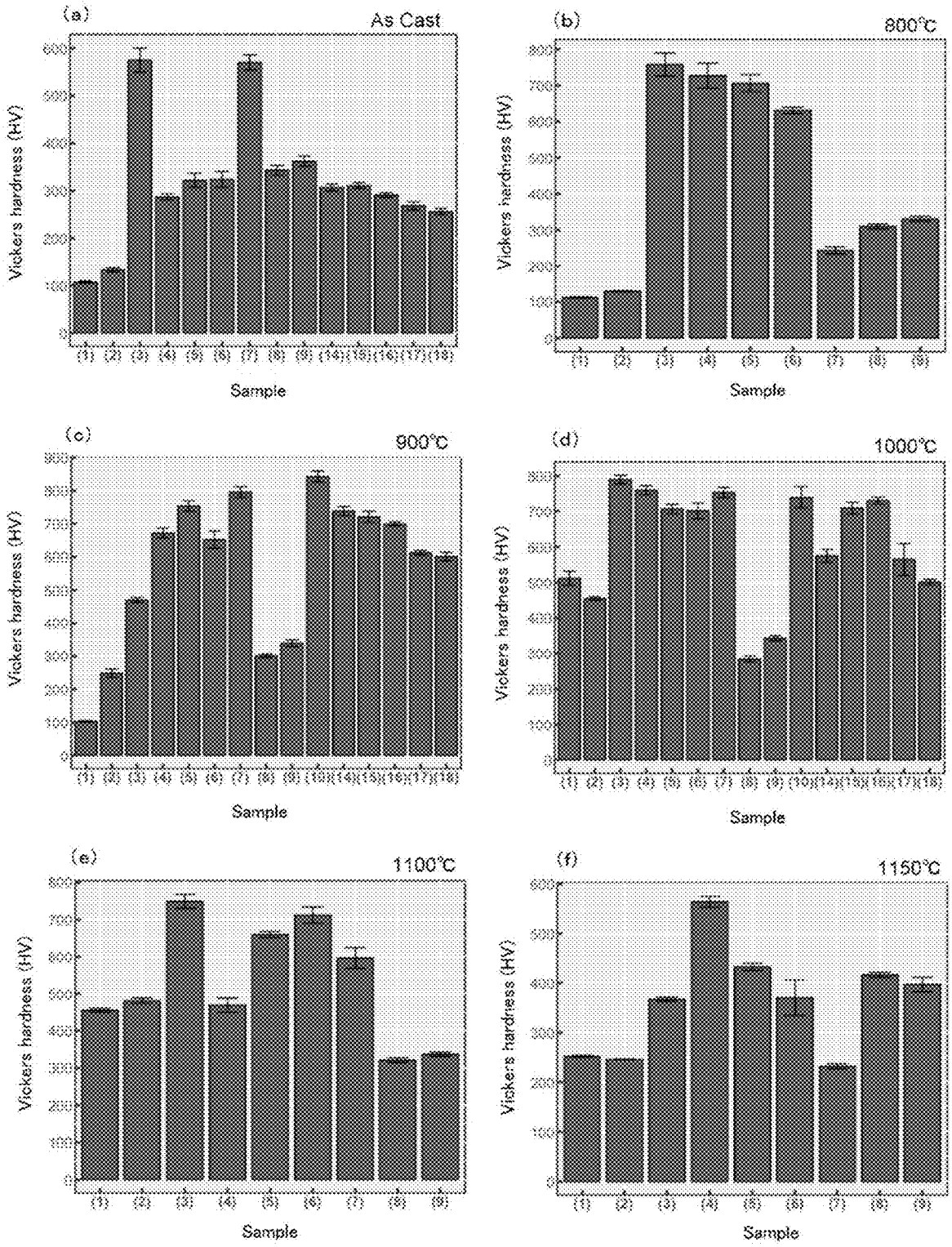
FIG. 1 shows graphs illustrating Vickers hardnesses for: (a) cast materials (As Cast) of the samples of (1) to (9) and (14) to (18); (b) quenched materials of the samples (1) to (9) subjected to heat treatment at 800° C. for 2 hours; (c) quenched materials of the samples (1) to (10) and (14) to (18) subjected to heat treatment at 900° C. for 2 hours; (d) quenched materials of the samples (1) to (10) and (14) to (18) subjected to heat treatment at 1000° C. for 2 hours; (e) quenched materials of the samples (1) to (9) subjected to heat treatment at 1100° C. for 2 hours; and (f) quenched materials of the samples (1) to (9) subjected to heat treatment at 1150° C. for 2 hours of the iron-based alloys according to embodiments of the present invention.

Below, the embodiments of the present invention will be described with reference to Examples, the appended drawings, and the like The iron-based alloy of an embodiment of the present invention includes Cr: 10 to 22 mass %, W: 1 to 12 mass %, and C: 0.1 to 2.3 mass %, with the remainder being unavoidable impurities and Fe. Further, the iron-based alloy according to an embodiment of the present invention may further include Cu: 0.5 to 6 mass % and/or Ni: 0.5 to 2.5 mass %. Moreover, the iron-based alloy according to an embodiment of the present invention may further include at least one of Al, Mo, and Si in an amount of 1 to 3 mass %.

The iron-based alloy of an embodiment of the invention can be suitably manufactured by the method for manufacturing an iron-based alloy according to an embodiment of the present invention. In the method for manufacturing an iron-based alloy according to an embodiment of the invention, the iron-based alloy according to an embodiment of the invention can first be manufactured to be composed of cast material by casting a composition of raw materials so as to obtain a composition of the iron-based alloy according to the embodiment of the invention.

As the addition amount of Cr of the cast material is 10 mass % to 22 mass %, the addition amount of W is 1 mass % to 12 mass %, and the addition amount of C is 0.1 mass % to 2.3 mass % in the iron-based alloy according to an embodiment of the invention, a high-temperature range can be achieved where an austenite having a face-centered cubic structure is stabilized. In the method for manufacturing an iron-based alloy according to an embodiment of the invention, a cast material or a material obtained by processing the cast material may be subjected to heat treatment at the high-temperature range, i.e., 600° C. to 1250° C. for 0.5 to 24 hours, and subsequent quenching in iced water and the like. This can induce martensitic transformation to form a high-hardness martensitic structure composed of a matrix mainly having a body-centered cubic structure, and further to form carbides composed mainly of the $M_{23}C_6$ type. It is noted that the carbides may include those of the $M_6C$ type, the $M_7C_3$ type, the MC type, and the like. Martensitic transformation may also be induced during cooling by using a water-cooling mold as in the arc melting method and using a fast cooling rate in a casting process to form a high-hardness martensitic structure and carbides. In this way, the iron-based alloy of an embodiment of the invention can be manufactured as a quenched material having a structure composed mainly of martensite in which carbides are precipitated or a cast material. Use of martensitic transformation can provide a high-hardness matrix structure while the presence of carbides can further enhance hardness.

For the iron-based alloy of an embodiment of the present invention, a quenched material includes carbides. Here, the carbides generally include a large amount of Cr, and thus corrosion resistance could be decreased for a matrix having a decreased concentration of Cr. Further, it would be feared that galvanic corrosion might occur between the carbides and the matrix. The iron-based alloy of an embodiment of the invention can prevent the aforementioned decreased corrosion resistance due to the formation of carbides by adding Cu or Ni. In addition, corrosion resistance or oxidation resistance can further be enhanced by adding Al, Mo, and/or Si.

For the iron-based alloy according to an embodiment of the present invention, both a cast material and a quenched material have excellent corrosion resistance along with high strength. The iron-based alloy according to an embodiment of the present invention preferably has excellent corrosion resistance against, for example, sulfuric acid, hydrochloric acid, hydrofluoric acid, nitric acid, and the like depending on corrosive environments. For the iron-based alloy according to an embodiment of the present invention, a cast material may be composed of an austenitic structure or a ferritic structure. When this is the case, plastic working and the like will be unlikely to cause cracks and the like, and good workability can be obtained. Alternatively, the cast material may be composed of a martensitic structure. When this is the case, the cast material can be directly used without performing plastic working. For the iron-based alloy according to an embodiment of the present invention, a quenched material does not necessarily have a structure consisting only of martensite and carbides, but may include, for example, a trace amount of ferrite or residual austenite depending on alloy compositions or heat treatment conditions. In the method for manufacturing an iron-based alloy according to an embodiment of the present invention, a quenched material composed mainly of a martensitic structure may be subjected to tempering in order to enhance toughness or hardness.

The iron-based alloy according to an embodiment of the present invention can be manufactured inexpensively with common dissolving/processing equipment without using powder metallurgy technology. It can also be processed into a desired shape by hot and cold working (rolling, forging, swaging, and the like) by virtue of its excellent plastic workability. Further, working processes can eliminate solidification segregation and the like to obtain homogeneous structures/properties. Moreover, the iron-based alloy according to an embodiment of the present invention can be highly hardened by quenching, and thus a cast material and the like before quenching can be subjected to plastic working, machining, or the like to shape it into a desired product shape such as a screw.

The iron-based alloy according to an embodiment of the present invention may be used for any applications where excellent corrosion resistance and high strength are required, including plasticizing apparatuses, molds, or the like, for resin molding. The iron-based alloy according to an embodiment of the present invention has corrosion resistance capable of withstanding corrosion due to sulfurous acid gas generated upon melting of PPS resin, and high hardness (abrasion resistance) capable of withstanding abrasive wear due to a hard filler (GF), for example, when used in a plasticizing apparatus for molding PPS resin.

Below, a cast material and a quenched material of the iron-based alloy according to an embodiment of the present invention were manufactured, and subjected to measurement of hardness, corrosion-resistance evaluation tests, structural observation, measurement of dislocation density, and the like. Further, thermodynamic calculations were performed for the iron-based alloys according to embodiments of the present invention to study heat treatment temperatures for quenching and composition ranges.

Example 1

Manufacture of Test Samples

Ingots (cast materials) of the samples (1) to (18) and (20) to (24) having the alloy compositions shown in Table 1 were fabricated with an arc melting furnace and a water-cooled copper mold. The weight of each ingot was about 100 g. Further, some of each ingot was heat treated in a muffle furnace in the atmosphere at a temperature range of 800 to 1150° C. for 2 hours, and then quenched in iced water to manufacture a quenched material of each sample. It is noted that the iron-based alloys according to embodiments of the invention correspond to the samples (4) to (6), (8) to (11), (15) to (18), and (20) to (24).

TABLE 1

| Sample No. | Fe | Cr | W | C | Cu | Ni | Al | Mo | Si |
|---|---|---|---|---|---|---|---|---|---|
| (1) | Bal. | 4 | 3 | — | — | — | — | — | — |
| (2) | Bal. | 4 | 3 | — | 2 | — | — | — | — |
| (3) | Bal. | 4 | 3 | 1 | 2 | — | — | — | — |
| (4) | Bal. | 13 | 3 | 1 | 2 | — | — | — | — |
| (5) | Bal. | 16 | 3 | 1 | 2 | — | — | — | — |
| (6) | Bal. | 20 | 3 | 1 | 2 | — | — | — | — |
| (7) | Bal. | 4 | 3 | 1 | 2 | — | 2 | 2 | — |
| (8) | Bal. | 16 | 3 | 1 | 2 | — | 2 | 2 | — |
| (9) | Bal. | 16 | 3 | 1 | 2 | — | 2 | 2 | 2 |
| (10) | Bal. | 13 | 3 | 1 | — | — | — | — | — |
| (11) | Bal. | 16 | 9 | 1 | 2 | — | — | — | — |
| (12) | Bal. | 16 | 3 | — | — | — | — | — | — |
| (13) | Bal. | 16 | 3 | 1 | — | — | — | — | — |
| (14) | Bal. | 16 | — | — | — | — | — | — | — |
| (15) | Bal. | 16 | 3 | 1 | 0.5 | 1 | — | — | — |
| (16) | Bal. | 16 | 3 | 1 | 0.5 | 2 | — | — | — |
| (17) | Bal. | 16 | 3 | 1 | 1 | 2 | — | — | — |
| (18) | Bal. | 16 | 3 | 1 | 2 | 2 | — | — | — |
| (20) | Bal. | 16 | 3 | 1 | 5 | — | — | — | — |
| (21) | Bal. | 16 | 3 | 1 | 1 | — | — | — | — |
| (22) | Bal. | 16 | 3 | 0.5 | 2 | — | — | — | — |
| (23) | Bal. | 16 | 3 | 1.5 | 2 | — | — | — | — |
| (24) | Bal. | 16 | 3 | 2 | 2 | — | — | — | — |

Test Method

A cast material and a quenched material of each sample were subjected to measurement of Vickers hardness, corrosion-resistance evaluation tests, and structural observation. Vickers hardness was measured with an "HMV" available from Shimadzu Corporation under the following conditions: a load of 9.81 N (1 kg) and a pressing time of 10 seconds.

For corrosion-resistance evaluation tests, each sample was immersed into a 0.5 mol/L aqueous solution of sulfuric acid at room temperature, which simulated corrosion due to sulfurous acid gas, and the corrosion resistance (anti-sulfuric acid corrosion) of each sample was then evaluated based on the weight loss after a holding time of 1 to 7 hours. A sample piece to be immersed into an aqueous solution of sulfuric acid was subjected to surface polishing in advance with emery paper up to #3000.

The following method and equipment were used to evaluate structures.

- X ray diffraction (XRD) measurement: an "X'Pert MPD" available from PANalytical.
- Scanning electron microscope (SEM) observation: an "S-3400N" available from HITACHI (acceleration voltage: 15 kV).
- Analysis with a field-emission electron probe micro analyzer (EPMA): a "JXA-8530F" available from JEOL (acceleration voltage: 15 kV).
- Scanning transmission electron microscope (STEM) observation: a "Titan$^3$ 60-300 Probe Corrector" available from FEI (acceleration voltage: 300 kV).

For a sample to be used in XRD and EPMA, a surface to be analyzed was mirror-finished in advance using emery paper, alumina, and colloidal silica. A sample for TEM observation was prepared using a focused ion beam (FIB) instrument (a "Versa 3D Dual Beam" available from FEI).

Test Results

FIGS. 1(*a*) to (*f*) show the Vickers hardnesses for cast materials and quenched materials of samples (1) to (10) and (14) to (18). As shown in FIG. 1(*a*), samples (4) to (6), (8), (9), and (15) to (18), which were iron-based alloys of embodiments of the present invention, had high hardness as they were evidenced to have a Vickers hardness of HV 250 or more even though they were cast materials before quenching (As Cast). Further, as shown in FIGS. 1(*a*) to (*f*), samples (4) to (6), (8), (9), and (15) to (18), which were iron-based alloys according to embodiments of the invention, were highly hardened by quenching although the optimal temperatures for heat treatment were different depending on the compositions. In particular, samples (8) and (9), to which Al, Mo, and also Si were added with the expectation of improved corrosion resistance and oxidation resistance, were highly hardened as they were evidenced to have a Vickers hardness of about HV 400 by selecting an appropriate temperature (1150° C.). Further, samples (15) to (18) having a portion of Cu replaced with Ni were highly hardened as they were evidenced to have an HV of 500 or more by quenching after heat treatment at 900° C. to 1000° C.

Figure 2:
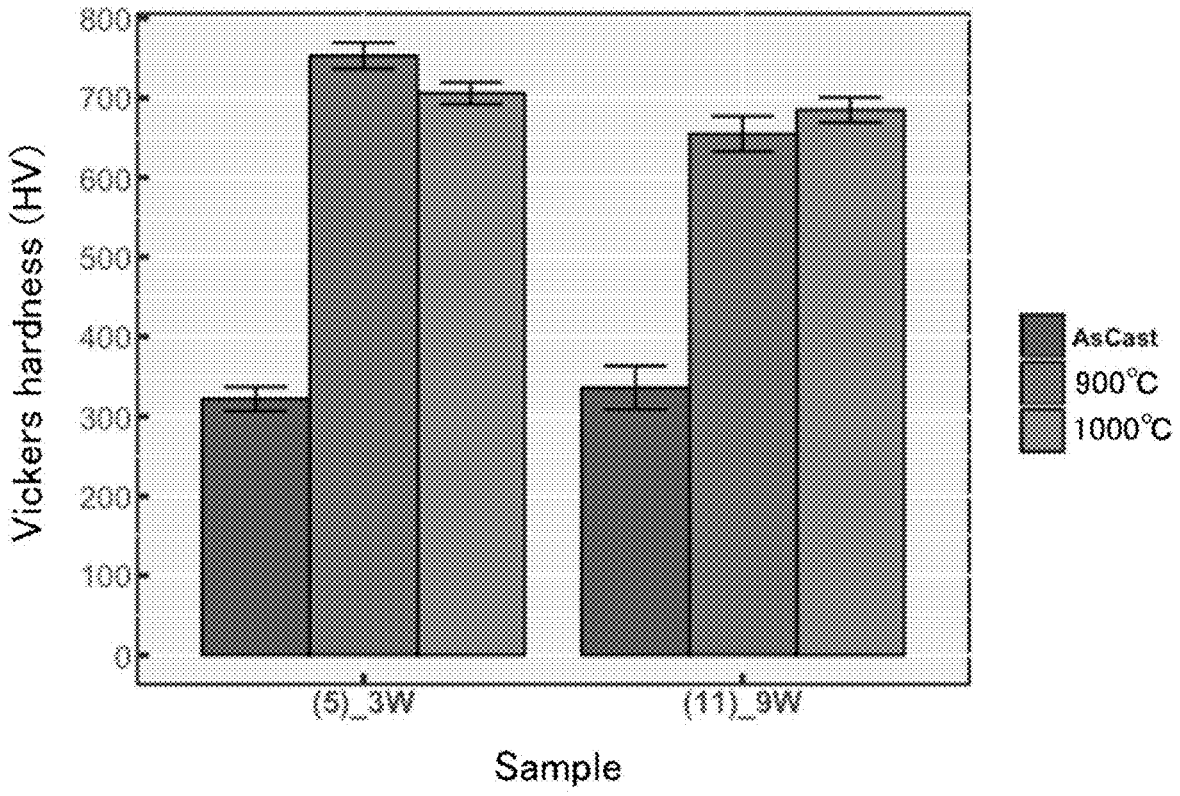
FIG. 2 shows a graph illustrating Vickers hardnesses for cast materials of the samples (5) and (11), a quenched material subjected to heat treatment at 900° C. for 2 hours, and a quenched material subjected to heat treatment at 1000° C. for 2 hours of the iron-based alloys according to embodiments of the present invention.

FIG. 2 shows the Vickers hardnesses for cast materials and quenched materials subjected to heat treatment at 900° C. or 1000° C. of the sample (5) in which the addition amount of W was 3 mass % and the sample (11) in which the addition amount of W was 9 mass %. As shown in FIG. 2, the sample (11) had high hardness as it was evidenced to have an HV 600 or more although it had lower hardness after quenching as compared with sample (5).

Figure 3:
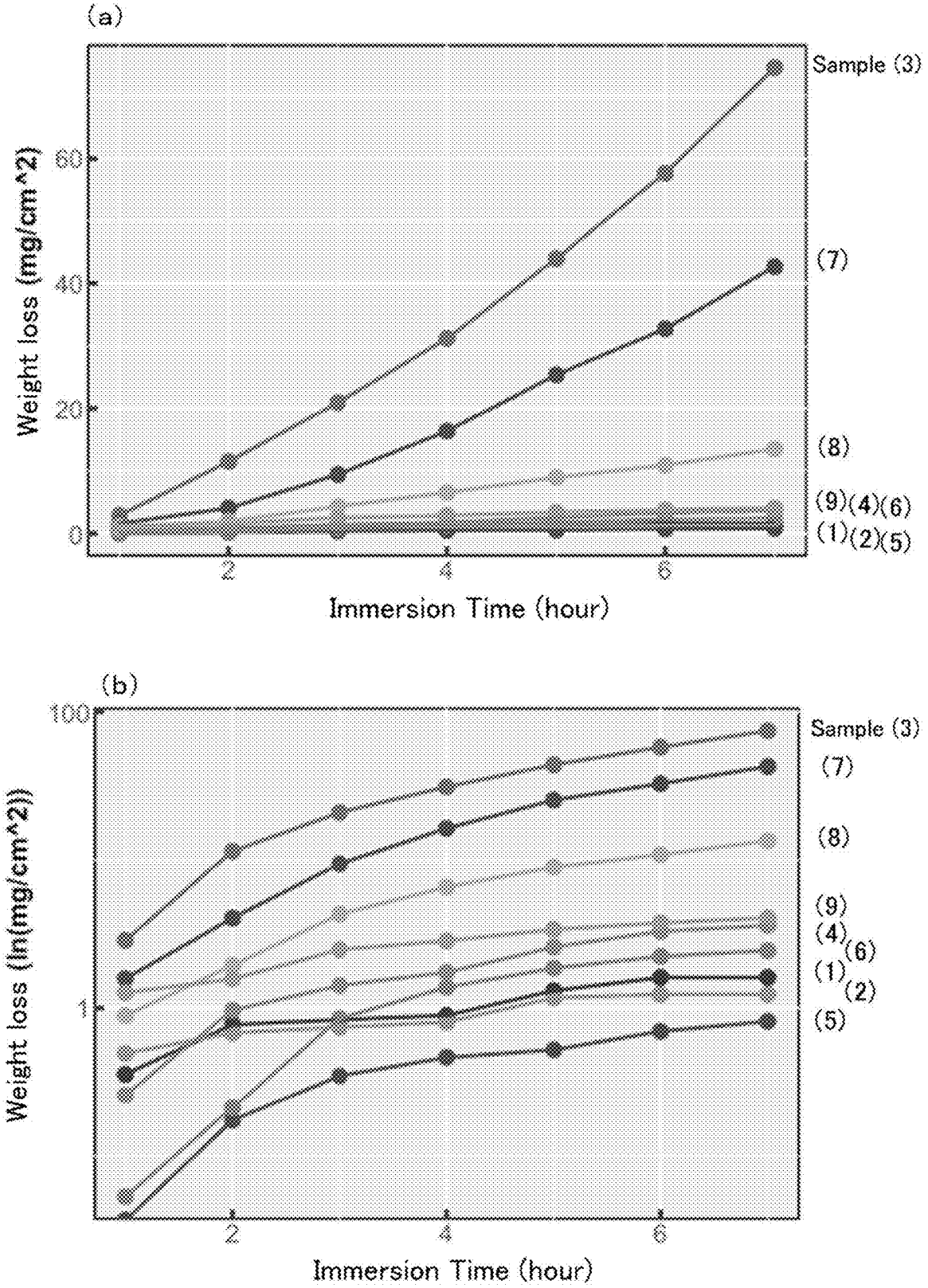
FIG. 3 shows (a) a graph illustrating the time-dependent change of the weight loss with respect to the immersion time into a 0.5 mol/L aqueous solution of sulfuric acid in the corrosion-resistance evaluation tests for cast materials of the samples (1) to (9) of the iron-based alloys according to embodiments of the present invention, and (b) a graph in which the vertical axis of (a) is expressed in a logarithmic scale.

FIG. 3 shows the time-dependent change of the weight loss with respect to the immersion time in the corrosion-resistance evaluation tests for cast materials of the samples (1) to (9). As shown in FIG. 3, samples (3) and (7), in which the addition amount of Cr was 4 mass %, had larger weight loss, indicating inferior corrosion resistance. These results suggest that even a Cu-containing alloy cannot gain high corrosion resistance if the addition amount of Cr is less than 10 mass %. It is noted that samples (1) and (2), in which the addition amount of Cr was 4 mass %, showed good corrosion resistance, but had lower hardness as shown in FIG. 1(*a*) because C was not added.

Figure 4:
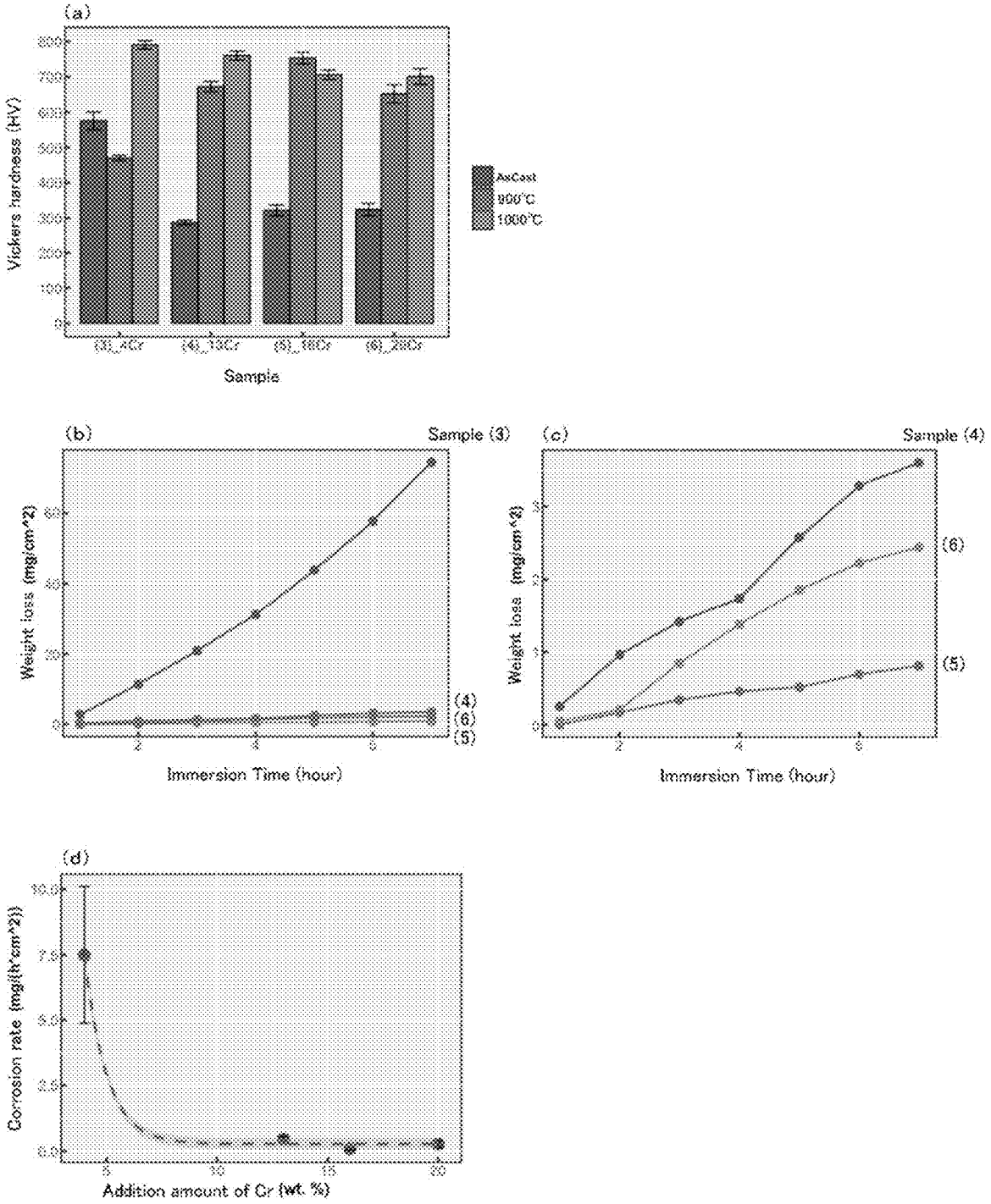
FIG. 4 shows (a) a graph illustrating Vickers hardnesses for cast materials, quenched materials subjected to heat treatment at 900° C. for 2 hours, and quenched materials subjected to heat treatment at 1000° C. for 2 hours of the samples (3) to (6) of the iron-based alloys according to embodiments of the present invention; (b) a graph illustrating the time-dependent change of the weight loss with respect to the immersion time into a 0.5 mol/L aqueous solution of sulfuric acid in the corrosion-resistance evaluation tests for the cast materials; (c) an enlarged portion of the samples (4) to (6) in the graph (b); and (d) a graph illustrating the corrosion rates against the addition amounts of Cr obtained from (b) and (c).

FIG. 4(*a*) shows the Vickers hardnesses for cast materials and quenched materials subjected to heat treatment at 900° C. or 1000° C. of samples (3) to (6), in which the addition amount of Cr was varied from 4 mass % to 20 mass %. FIGS. 4(*b*) and (*c*) show the time-dependent change of the weight loss with respect to the immersion time in the corrosion-resistance evaluation tests for cast materials. Further, the corrosion rate of each sample was obtained from FIGS. 4(*b*) and (*c*) using the following equation, and plotted against the addition amount of Cr, the results of which are shown in FIG. 4(*d*).

$$r = \frac{1}{k}\sum_{i=1}^{k}\frac{m_i}{i} \qquad \text{Equation 1}$$

wherein $m_i$ represents weight loss, and i represents immersion time. Tests are repeated 7 times for each sample (k=7).

As shown in FIG. 4(*a*), Vickers hardness does not significantly change as a function of the addition amount of Cr. Nonetheless, excellent corrosion resistance was obtained when the addition amount of Cr was 10 mass % or more, as shown in FIGS. 4(*b*) to (*d*). As shown in FIG. 4(*c*), sample (5), in which the addition amount of Cr was 16 mass %, had superior corrosion resistance as compared with sample (4), in which the addition amount of Cr was 13 mass %; but corrosion resistance did not significantly change even when the addition amount of Cr was further increased. These results suggest that the addition amount of Cr is preferably 10 mass % or more, and more preferably 16 mass % or more in order to obtain excellent corrosion resistance.

Figure 5:
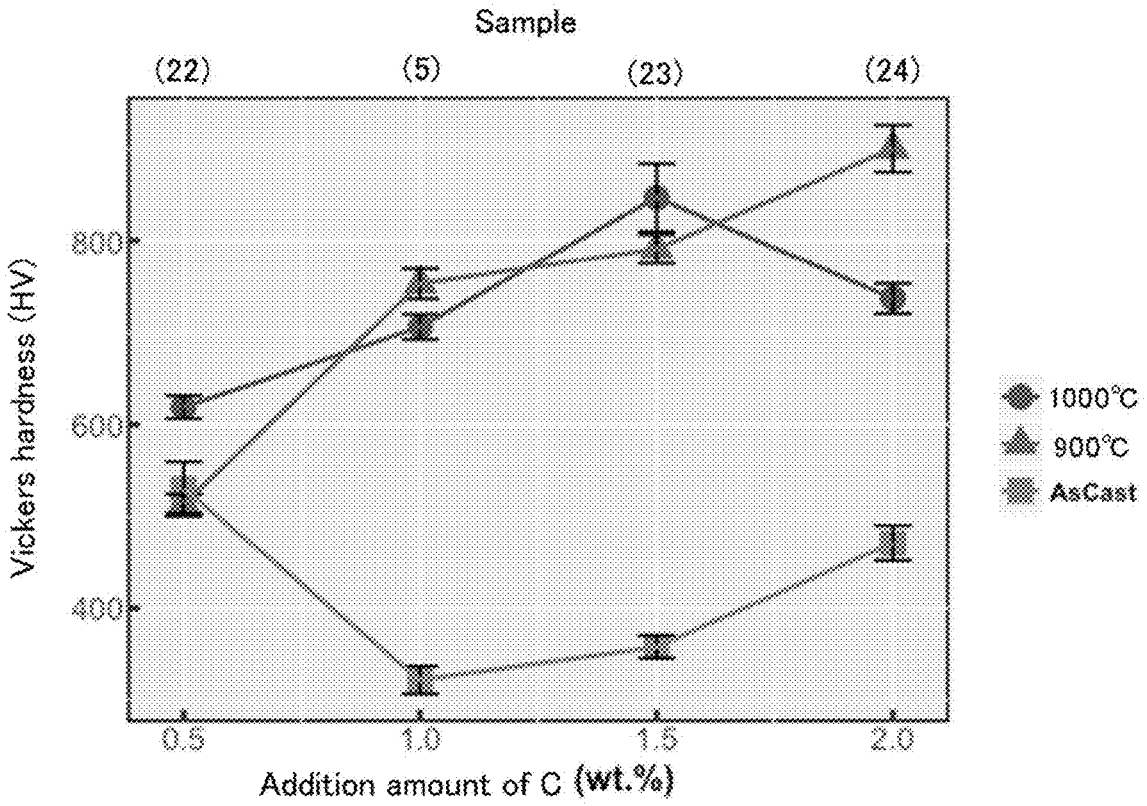
FIG. 5 shows a graph illustrating Vickers hardnesses for cast materials, quenched materials subjected to heat treatment at 900° C. for 2 hours, and quenched materials subjected to heat treatment at 1000° C. for 2 hours of the samples (5) and (22) to (24) of the iron-based alloys according to embodiments of the present invention.

FIG. 5 shows the Vickers hardnesses for cast materials and quenched materials subjected to heat treatment at 900° C. or 1000° C. of samples (5) and (22) to (24), in which the addition amount of C was varied from 0.5 mass % to 2.0 mass %. As shown in FIG. 5, all of the samples showed HV 500 or more after quenching, indicating that high hardness was obtained.

Figure 6:
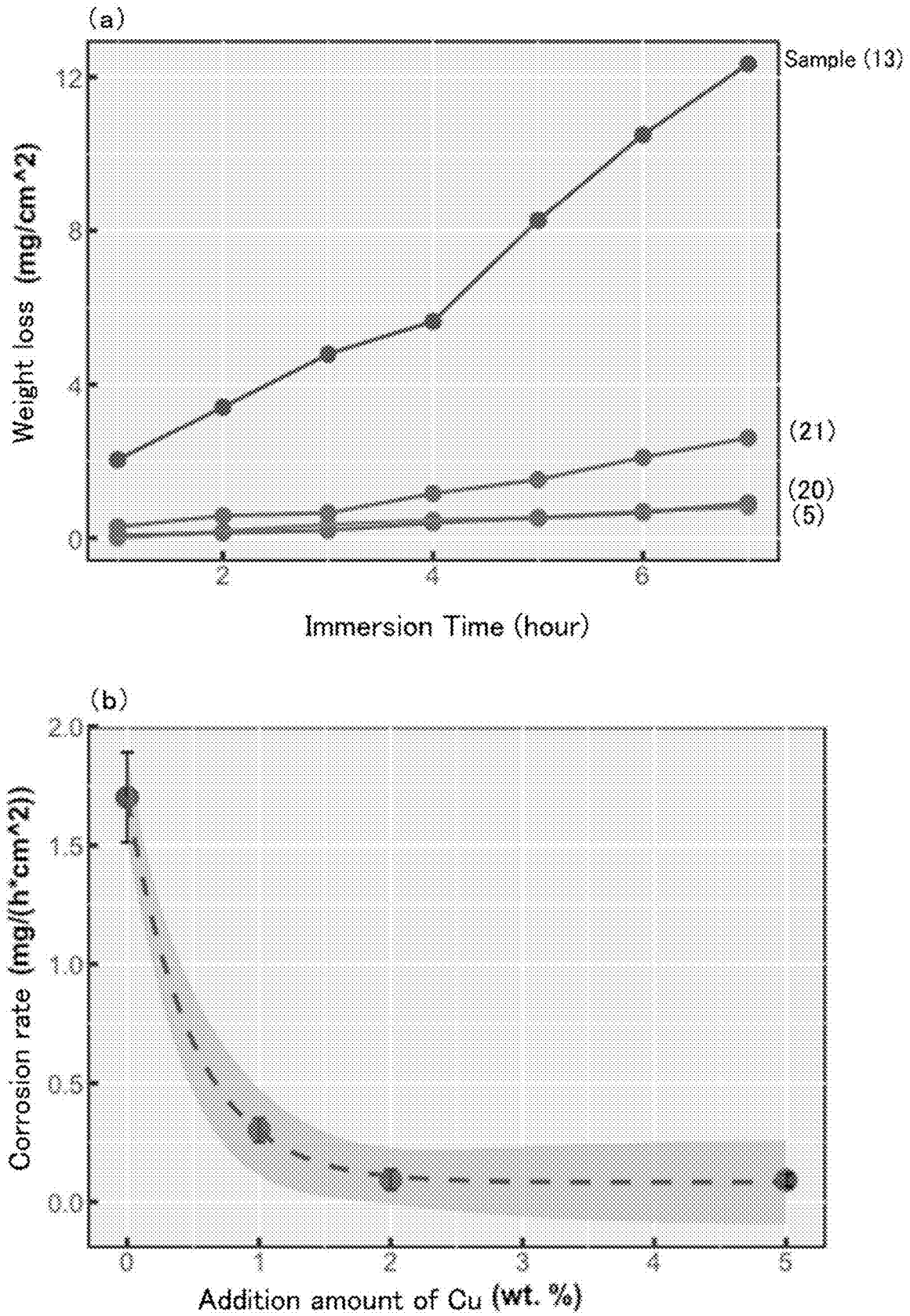
FIG. 6 shows (a) a graph illustrating the time-dependent change of the weight loss with respect to the immersion time into a 0.5 mol/L aqueous solution of sulfuric acid in the corrosion-resistance evaluation tests for cast materials of the samples (5), (13), (20), and (21) of the iron-based alloys according to embodiments of the present invention; and (b) a graph illustrating the corrosion rates against the addition amounts of Cu obtained from (a).

FIG. 6(*a*) shows that the time-dependent change of the weight loss with respect to the immersion time in the corrosion-resistance evaluation tests for cast materials of samples (5), (13), (20), and (21), in which the addition amount of Cu was varied from 0 mass % to 5 mass %. Further, as in FIG. 4(*d*), the corrosion rate of each sample was obtained from FIG. 6(*a*), and plotted against the addition amount of Cu, the results of which are shown in FIG. 6(*b*). As shown in FIGS. 6(*a*) and (*b*), the corrosion rate was significantly decreased by adding even a small amount of Cu to the sample (13) having no Cu added, while corrosion resistance did not significantly change when the addition amount of Cu was increased to 1 mass % or more. These results suggest that the addition amount of Cu is preferably 0.5 mass % or more.

Figure 7:
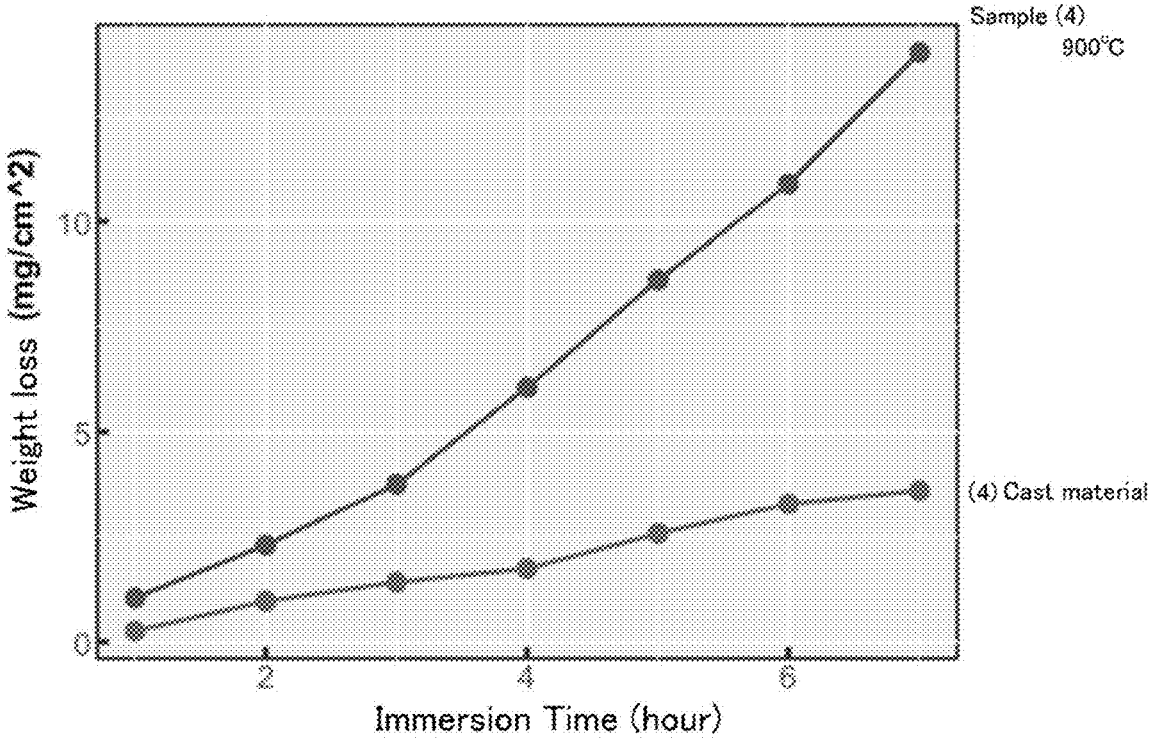
FIG. 7 shows a graph illustrating the time-dependent change of the weight loss with respect to the immersion time into a 0.5 mol/L aqueous solution of sulfuric acid in the corrosion-resistance evaluation tests for a cast material and a quenched material subjected to heat treatment at 900° C. for 2 hours of the sample (4) of the iron-based alloys according to embodiments of the present invention.

FIG. 7 shows the time-dependent change of the weight loss with respect to the immersion time in the corrosion-resistance evaluation tests for a cast material and a quenched material subjected to heat treatment at 900° C. of the sample (4). As shown in FIG. 7, corrosion resistance was slightly decreased, but the value of weight loss was small. These results suggest that the sample (4) gains significantly high hardness while maintaining excellent corrosion resistance (refer to FIG. 1).

Figure 8:
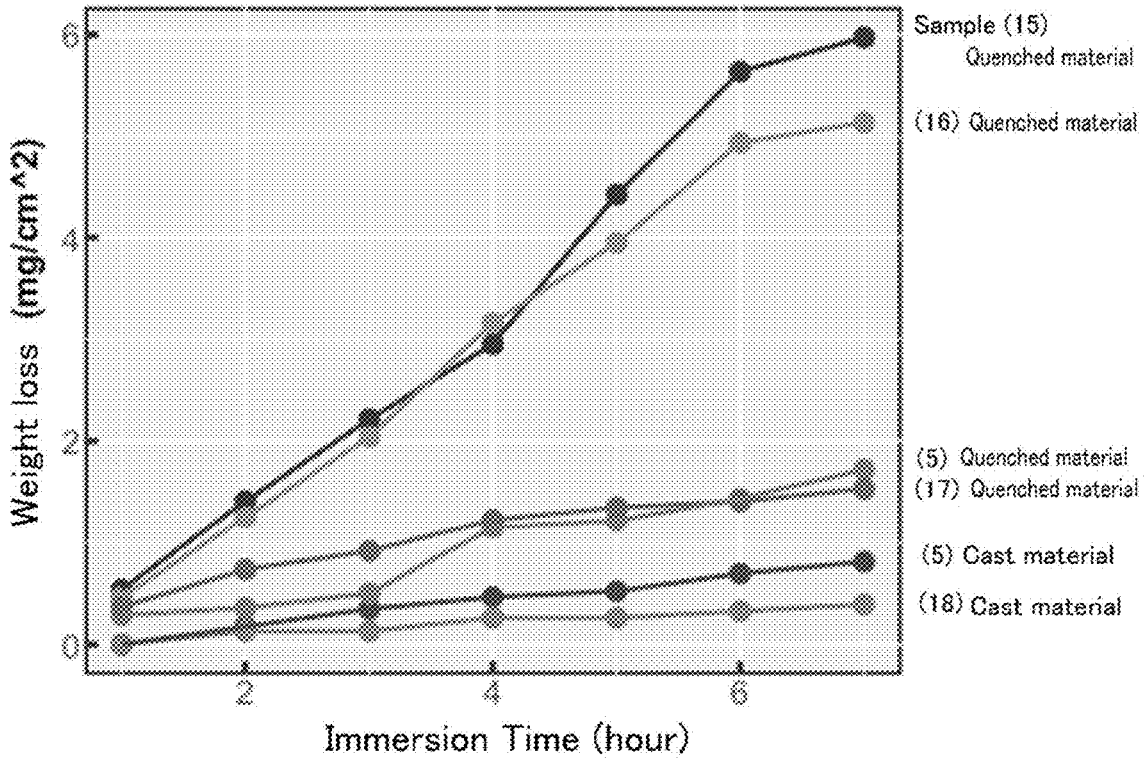
FIG. 8 shows a graph illustrating the time-dependent change of the weight loss with respect to the immersion time into a 0.5 mol/L aqueous solution of sulfuric acid in the corrosion-resistance evaluation tests for cast materials and/or quenched materials subjected to heat treatment at 1000° C. for 2 hours of the samples (5) and (15) to (18) of the iron-based alloys according to embodiments of the present invention.

FIG. 8 shows the time-dependent change of the weight loss with respect to the immersion time in the corrosion-resistance evaluation tests for cast materials and/or quenched materials subjected to heat treatment at 1000° C. of samples (15) to (18) in which Ni was added and the addition amount of Cu was varied in sample (5). As shown in FIG. 8, corrosion resistance was increased as the addition amount of Cu increased. Further, the quenched materials had slightly decreased corrosion resistance as compared with the cast materials, but the values of weight loss were small. These results suggest that quenching can confer significantly high hardness on these samples while maintaining excellent corrosion resistance (refer to FIG. 1).

Figure 9:
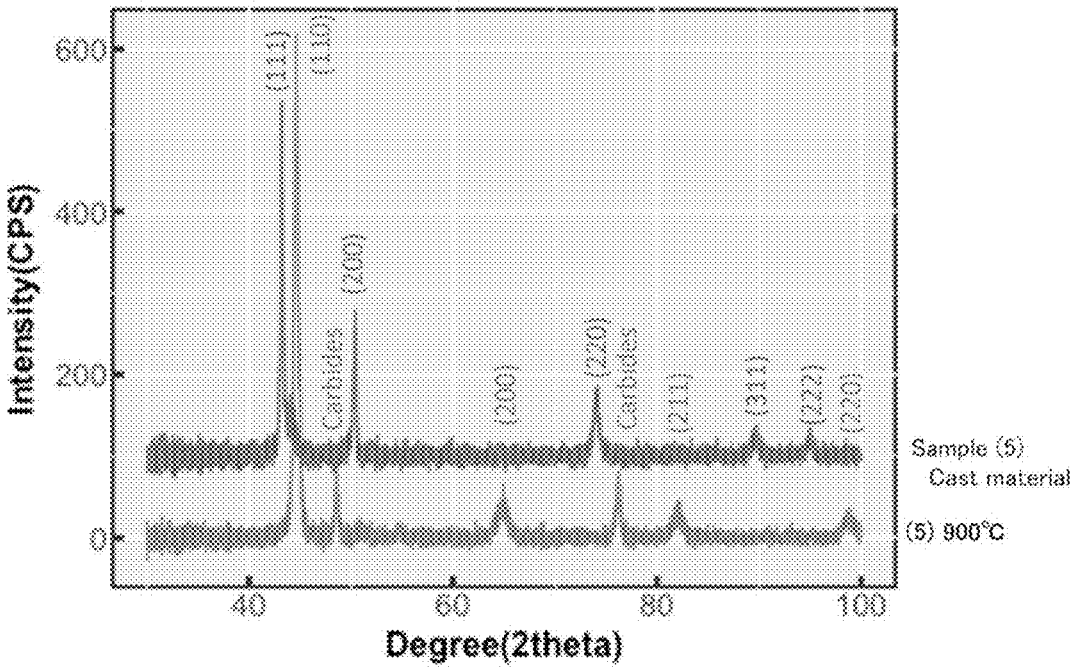
FIG. 9 shows XRD patterns of a cast material and a quenched material subjected to heat treatment at 900° C. for 2 hours of the sample (5) of the iron-based alloys according to embodiments of the present invention.

FIG. 9 shows the XRD patterns of a cast material and a quenched material subjected to heat treatment at 900° C. of sample (5). As shown in FIG. 9, an austenite having a face-centered cubic structure was observed in the cast material, while peaks from a martensite having a body-centered cubic structure and carbides were mainly observed in the quenched material. Diffraction peaks after quenching are broad, suggesting that there are many lattice defects inside the crystal structure. This presumably indicates that martensitic transformation has occurred.

Figure 10:
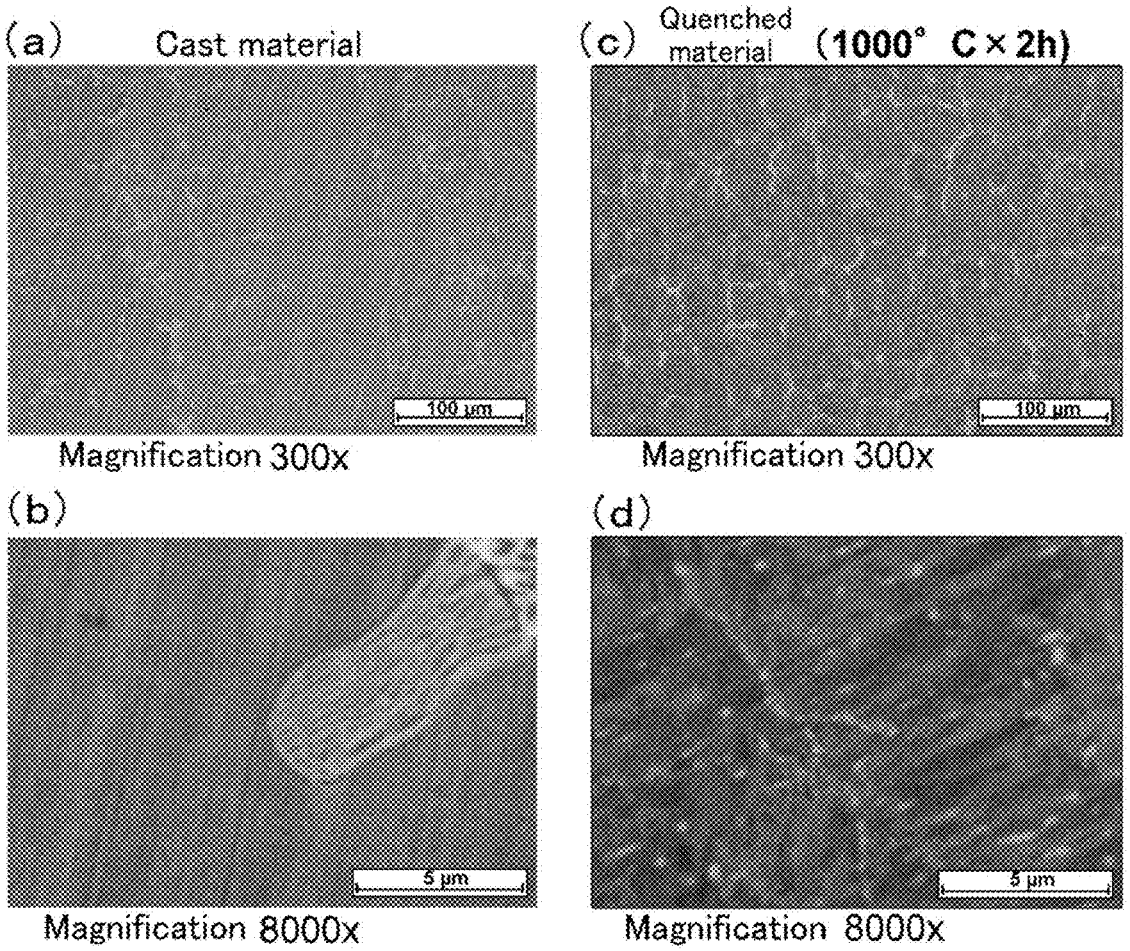
FIG. 10 shows (a) a SEM photograph (a reflection electron image) of a cast material of the sample (17) of the iron-based alloy according to an embodiment of the present invention; (b) a SEM photograph of (a) enlarged at a higher magnification; (c) a SEM photograph for a quenched material of the sample (17) subjected to heat treatment at 1000° C. for 2 hours; and (d) a SEM photograph of (c) enlarged at a higher magnification.
Figure 11:
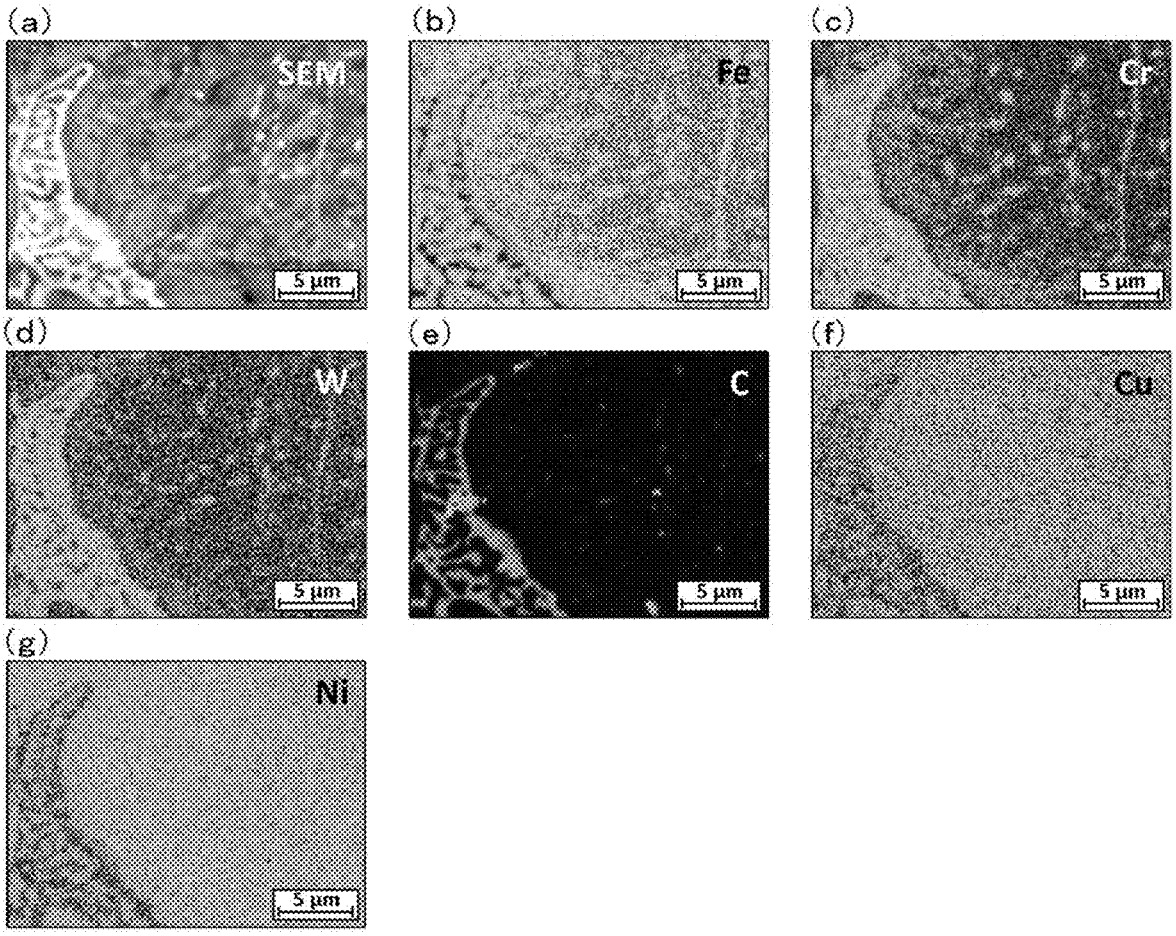
FIG. 11 shows (a) a SEM photograph (a reflection electron image) for a quenched material of the sample (17) subjected to heat treatment at 1000° C. for 2 hours of the iron-based alloy of an embodiment of the present invention; and EPMA maps of (b) Fe, (c) Cr, (d) W, (e) C, (f) Cu, and (g) Ni.

FIG. 10 shows the SEM observation results (backscattered electron images) of a cast material and a quenched material subjected to heat treatment at 1000° C. of sample (17). Further, FIG. 11 shows results from EPMA analysis on additive element in the quenched material. As shown in FIG. 10, precipitates shown in bright contrast were observed in addition to the matrix for both the cast material and the quenched material. Further, as shown in FIG. 11, Cr, W, and C were enriched in the precipitates shown in bright contrast in the backscattered electron images (SEM), indicating that these precipitates were carbides. Further, preferential distribution of Cu and Ni in the matrix is considered to be responsible for improved corrosion resistance.

Example 2

In order to achieve high hardness by quenching, heat treatment needs to be performed at a temperature range where austenite is stable. A temperature range and a composition rage where austenite is stable can be estimated by thermodynamic calculations. Accordingly, a thermodynamic calculation software "Thermo-Calc (available from Thermo-Calc Software: ver. 2017a, database: TCFE9: Steels/Fe-Alloys ver. 9.0" was used to investigate a heat treatment temperature for quenching the iron-based alloy according to an embodiment of the present invention and composition ranges of Cr and W.

Figure 12:
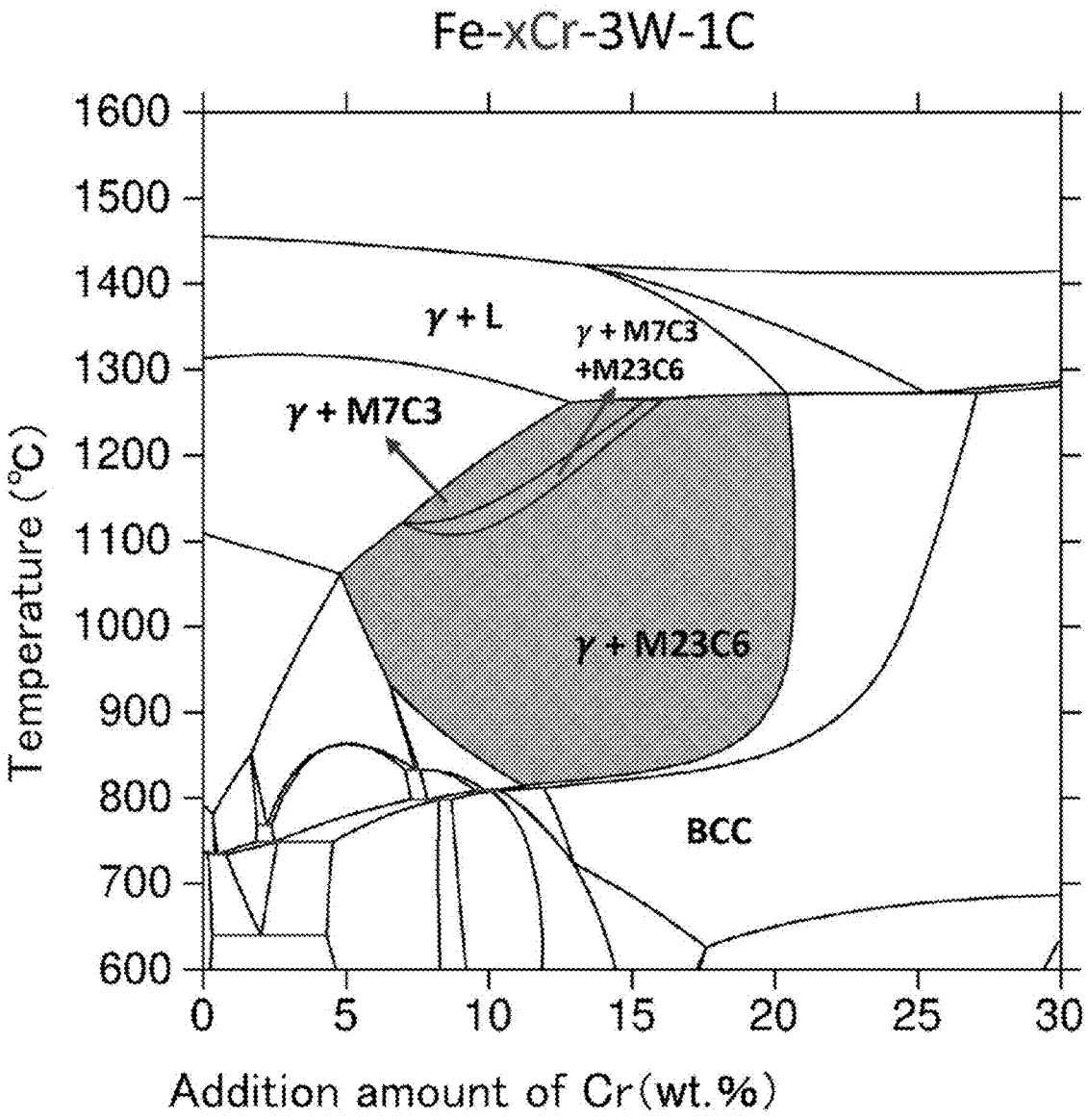
FIG. 12 shows a calculated phase diagram illustrating the results from thermodynamic calculations for Fe-xCr-3W-1C (unit: mass %, x=0 to 30)-based alloys as the iron-based alloys of embodiments of the present invention.
Figure 13:
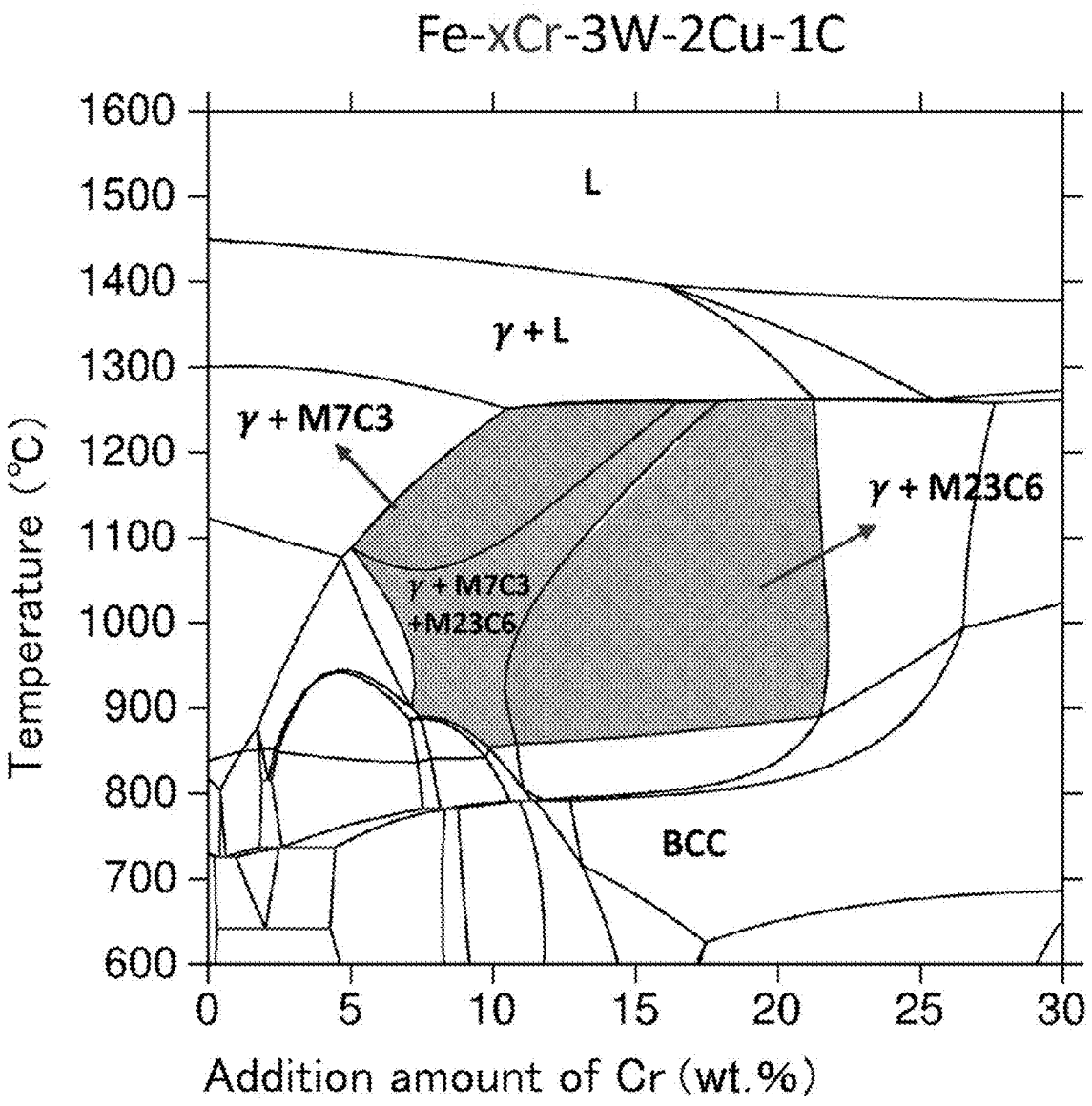
FIG. 13 shows a calculated phase diagram illustrating the results from thermodynamic calculations for Fe-xCr-3W-2Cu-1C (unit: mass %, x=0 to 30)-based alloys as the iron-based alloys of embodiments of the present invention.
Figure 14:
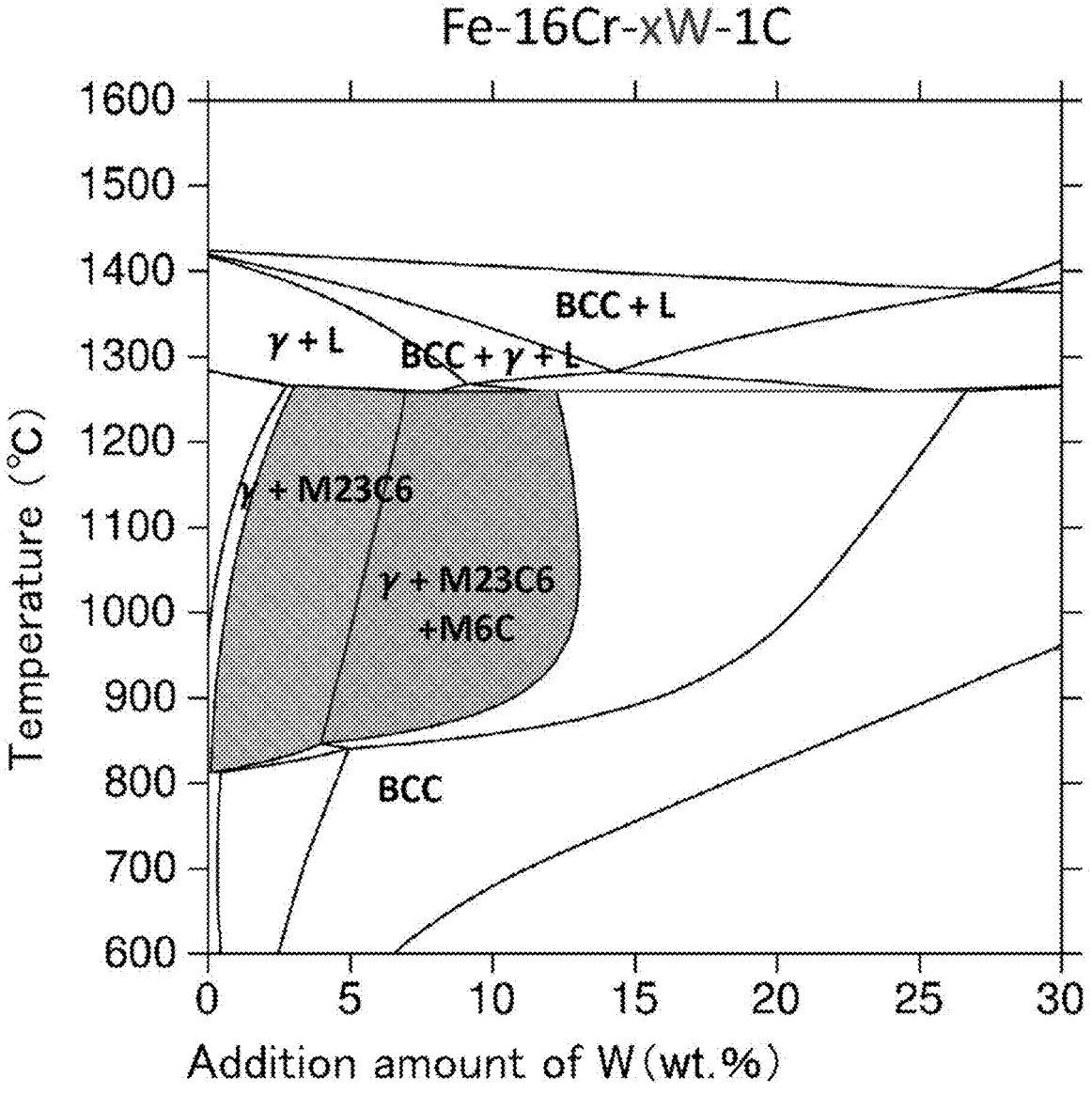
FIG. 14 shows a calculated phase diagram illustrating the results from thermodynamic calculations for an Fe-16Cr-xW-1C (unit: mass %, x=0 to 30)-based alloy as the iron-based alloy according to an embodiment of the present invention.

Thermodynamic calculations were performed on Fe-xCr-3W-1C (unit: mass %, x=0 to 30)-based alloys, Fe-xCr-3W-2Cu-1C (unit: mass %, x=0 to 30)-based alloys, and Fe-16Cr-xW-1C (unit: mass %, x=0 to 30) based alloys. FIGS. 12 to 14 show calculated phase diagrams thereof. In the figures, dark gray represents ranges where austenite is stably present. It is noted that Cu and Ni have small impact on the compositions/temperature ranges where austenite is stable.

As shown in FIG. 12, the ranges where austenite was stable for the Fe-xCr-3W-1C-based alloys were as follows: the heat treatment temperature was 800° C. to 1250° C., and the addition amount of Cr ranged from 5 mass % to 20 mass %. Further, as shown in FIG. 13, the ranges where austenite was stable for the Fe-xCr-3W-2Cu-1C-based alloys were as follows: the heat treatment temperature was 800° C. to 1250° C., and the addition amount of Cr ranged 5 mass % to 22 mass %. However, corrosion resistance needs to be considered when the addition amount of Cr is selected (for example, refer to FIG. 4).

As shown in FIG. 14, the ranges where austenite was stable for the Fe-16Cr-xW-1C-based alloys were as follows: the heat treatment temperature was 800° C. to 1250° C., and the addition amount of W ranged 12 mass % or less.

Example 3

In view of manufacture with industrial equipment, 30-kg ingots of two types of iron-based alloys of an Fe-13Cr-3W-1C-2Cu alloy (unit: mass %) and an Fe-16Cr-3W-1C-2Cu alloy (unit: mass %) were fabricated with a high-frequency induction furnace. Each of the ingots was subjected to homogenization heat treatment at 1200° C. for 4 hours, and then subjected to hot forging and hot rolling to produce a round bar material having a diameter of 30 mm. The round bar material was maintained at 850° C. for 2 hours, and then cooled in the furnace. Samples were cut out from the material obtained after cooling in the furnace (hereinafter referred to as an "ST material"), and each subjected to heat treatment under 4 conditions of 950° C., 1000° C., 1050° C., or 1100° C. with a holding time of 30 minutes to 4 hours, and then forcedly air-cooled. The resulting samples were each measured for a 10-point Rockwell hardness (HRC), and the mean value and the standard deviation were obtained.

The values of Rockwell hardness for the samples subjected to heat treatment for 2 hours are shown in Table 2. As shown in Table 2, the ST materials of the Fe-13Cr-3W-1C-2Cu alloy and the Fe-16Cr-3W-1C-2Cu alloy showed low values of HRC 28.0 (HV 286 in terms of Vickers hardness) and HRC 21.5 (HV 243 in terms of Vickers hardness), respectively, while the samples subjected to heat treatment at 950° C. to 1100° C. gained high hardness of HRC 50 or more (about HV 513 in terms of Vickers hardness). It was also observed that the sample subjected to heat treatment at 1050° C. gained hardness of more than HRC 60 (HV 697 in terms of Vickers hardness) regardless of the compositions. It was also observed that the samples subjected to heat treatment at 950° C. to 1100° C. showed small standard deviations, indicating that they were homogeneous materials. It is noted that high hardness was obtained in these experiments even without water quenching, and at a cooling rate as fast as that used in forced air cooling, suggesting high manufacturability with industrial equipment.

TABLE 2

| Composition | Temperature | Holding Time | Cooling Method | Rockwell hardness (HRC) Mean Value | S.D. |
|---|---|---|---|---|---|
| Fe—13Cr—3W—2Cu—1C | 850° C. | 2 hours | Cooling in furnace | 28.0 | 2.6 |
| Fe—16Cr—3W—2Cu—1C | | | | 21.5 | 0.6 |

TABLE 2-continued

| Composition | Temperature | Holding Time | Cooling Method | Rockwell hardness (HRC) Mean Value | S.D. |
|---|---|---|---|---|---|
| Fe—13Cr—3W—2Cu—1C | 950° C. | 2 hours | Forced air cooling | 56.8 | 0.6 |
| Fe—16Cr—3W—2Cu—1C | | | | 53.2 | 0.3 |
| Fe—13Cr—3W—2Cu—1C | 1000° C. | 2 hours | Forced air cooling | 61.9 | 0.5 |
| Fe—16Cr—3W—2Cu—1C | | | | 57.9 | 0.5 |
| Fe—13Cr—3W—2Cu—1C | 1050° C. | 2 hours | Forced air cooling | 62.9 | 0.3 |
| Fe—16Cr—3W—2Cu—1C | | | | 61.2 | 0.2 |
| Fe—13Cr—3W—2Cu—1C | 1100° C. | 2 hours | Forced air cooling | 59.5 | 0.3 |
| Fe—16Cr—3W—2Cu—1C | | | | 59.2 | 0.3 |

The values of Rockwell hardness for each of the samples subjected to heat treatment at 1050° C. for 30 minutes to 4 hours are shown in Table 3. As shown in Table 3, hardness after forced air cooling hardly changed with the alloy composition, and a value of about 60 HRC was obtained. Table 3 also shows the Rockwell hardnesses of the samples which were subjected to heat treatment at 1050° C. for 1 hour followed by forced air cooling, and then subjected to tempering heat treatment at 170° C. for 2 hours. Tempering conditions were selected with reference to JIS (Japanese Industrial Standards). As shown in Table 3, no large decrease in hardness was observed after tempering either, indicating that high hardness was able to be maintained.

TABLE 3

| Composition | Temp. | Holding Time | Cooling Method | Tempering Temp. | Tempering Time | Rockwell hardness (HRC) Mean Value | S.D. |
|---|---|---|---|---|---|---|---|
| Fe—13Cr—3W—2Cu—1C | 1050° C. | 30 minutes | Forced air cooling | — | — | 62.6 | 0.8 |
| Fe—16Cr—3W—2Cu—1C | | | | | | 60.0 | 0.4 |
| Fe—13Cr—3W—2Cu—1C | 1050° C. | 1 hour | Forced air cooling | — | — | 62.9 | 0.3 |
| Fe—16Cr—3W—2Cu—1C | | | | | | 61.0 | 0.2 |
| Fe—13Cr—3W—2Cu—1C | 1050° C. | 2 hours | Forced air cooling | — | — | 62.9 | 0.3 |
| Fe—16Cr—3W—2Cu—1C | | | | | | 61.2 | 0.2 |
| Fe—13Cr—3W—2Cu—1C | 1050° C. | 4 hours | Forced air cooling | — | — | 61.5 | 0.6 |
| Fe—16Cr—3W—2Cu—1C | | | | | | 59.8 | 1.0 |
| Fe—13Cr—3W—2Cu—1C | 1050° C. | 1 hour | Forced air cooling | 170° C. | 2 hours | 61.1 | 0.3 |
| Fe—16Cr—3W—2Cu—1C | | | | | | 57.9 | 0.3 |

Example 4

Test Samples and Test Method

Test samples were manufactured as follows. First, 30-kg ingots of an Fe-13Cr-3W-1C-2Cu alloy (unit: mass %) and an Fe-16Cr-3W-1C-2Cu alloy (unit: mass %) were ingoted in a heating furnace. Each of the ingots was subjected to homogenization heat treatment at 1200° C. for 4 hours and then subjected to hot forging twice at 900° C. to 1200° C. to produce a 50-mm square forged material. The forged material was subjected to hot rolling at 1150° C. for 1 hour to produce a round bar material having a diameter of 30 mm. The round bar material was maintained at 850° C. for 2 hours, and then cooled in the furnace. Cylindrical test pieces each having a diameter of 10 mm were cut out from the materials after cooling in the furnace, and each was sealed into a quartz tube, and then subjected to heat treatment under 4 conditions of 800° C., 900° C., 1000° C., or 1100° C. for a holding time of 1 hour in a muffle furnace, and then quenched in iced water to obtain test pieces. Compositions of the test samples manufactured are shown in Table 4.

TABLE 4

| Sample | Fe | Cr | W | Cu | C | S | O | N |
|---|---|---|---|---|---|---|---|---|
| 13Cr | Bal. | 12.98 | 2.94 | 1.97 | 0.98 | 0.003 | 0.0038 | 0.0052 |
| 16Cr | Bal. | 15.88 | 2.97 | 1.95 | 0.99 | 0.003 | 0.0024 | 0.0064 |

Values are expressed in the unit of mass %

For each of the test samples shown in Table 4, measurement of Vickers hardness, structural observation, neutron diffraction measurements, measurement of dislocation density, and corrosion-resistance evaluation tests were performed. It is noted that a sample of a quenched material of the Fe-13Cr-3W-1C-2Cu alloy is referred to as "13Cr," and a sample of a quenched material of the Fe-16Cr-3W-1C-2Cu is referred to as "16Cr."

Vickers hardness was measured with an "HMV" available from Shimadzu Corporation under the following conditions: a load of 9.81 N (1 kg) and a pressing time of 10 seconds. Structural observation was performed with a scanning electron microscope (SEM; "S-3400N" available from HITACHI) (acceleration voltage: 15 kV). For a sample to be used in SEM, a surface thereof was mirror-finished in advance using emery paper, alumina, and colloidal silica. Neutron diffraction measurements were performed with a "BL20 iMATERIA" at Japan Proton Accelerator Research Complex (J-PARC). A neutron diffraction pattern obtained from each sample was also subjected to line profile analysis by the CMWP (Convolutional Multiple Whole Profile) method to determine the dislocation density of a matrix phase comprised of a martensite or ferrite having a body-center cubic (BCC) structure, or composed of the both. It is noted that the dislocation density can also be obtained from the results of the observation of dislocation structures using X-ray diffraction including synchrotron radiation or (scanning) transmission electron microscopy. Other than the CMWP method, different approaches such as the modified Williamson-Hall/Warren-Averbach method and the like can also be used as the method of line profile analysis. For corrosion-resistance evaluation tests, each sample was immersed into a 0.5 mol/L aqueous solution of sulfuric acid at room temperature, and the corrosion resistance (anti-sulfuric acid corrosion) of each sample was then evaluated based on the weight loss after a holding time of up to 7 hours. A sample piece to be immersed into an aqueous solution of sulfuric acid, which had a diameter of 10 mm and a thickness of 2 mm, was subjected to surface polishing in advance with emery paper up to #3000.

Test Results

Figure 15:
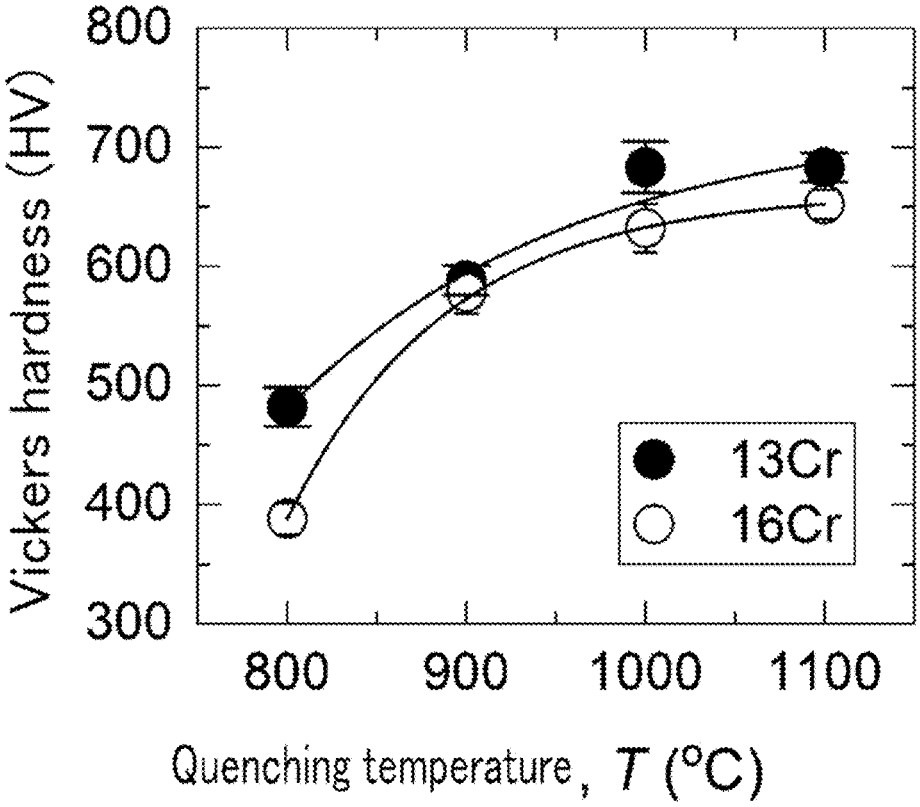
FIG. 15 shows a graph illustrating the relationship between quenching temperature and Vickers hardness for quenched materials of an Fe-13Cr-3W-1C-2Cu alloy (unit: mass %, "13Cr") and an Fe-16Cr-3W-1C-2Cu alloy (unit: mass %, "16Cr") as the iron-based alloys according to embodiments of the present invention.

FIG. 15 shows the relationship between heat treatment temperatures for quenching the samples of 13Cr and 16Cr (quenching temperature) respectively, and Vickers hardness. As shown in FIG. 15, hardness increased as the quenching temperature increased for all of the samples. Specifically, hardness was HV 500 or more when the quenching temperature was about 850° C. or more, and HV 600 or more when the quenching temperature was 950° C. or more. Further, higher hardness was obtained for the samples of 13Cr as compared with the samples of 16Cr.

Figure 16:
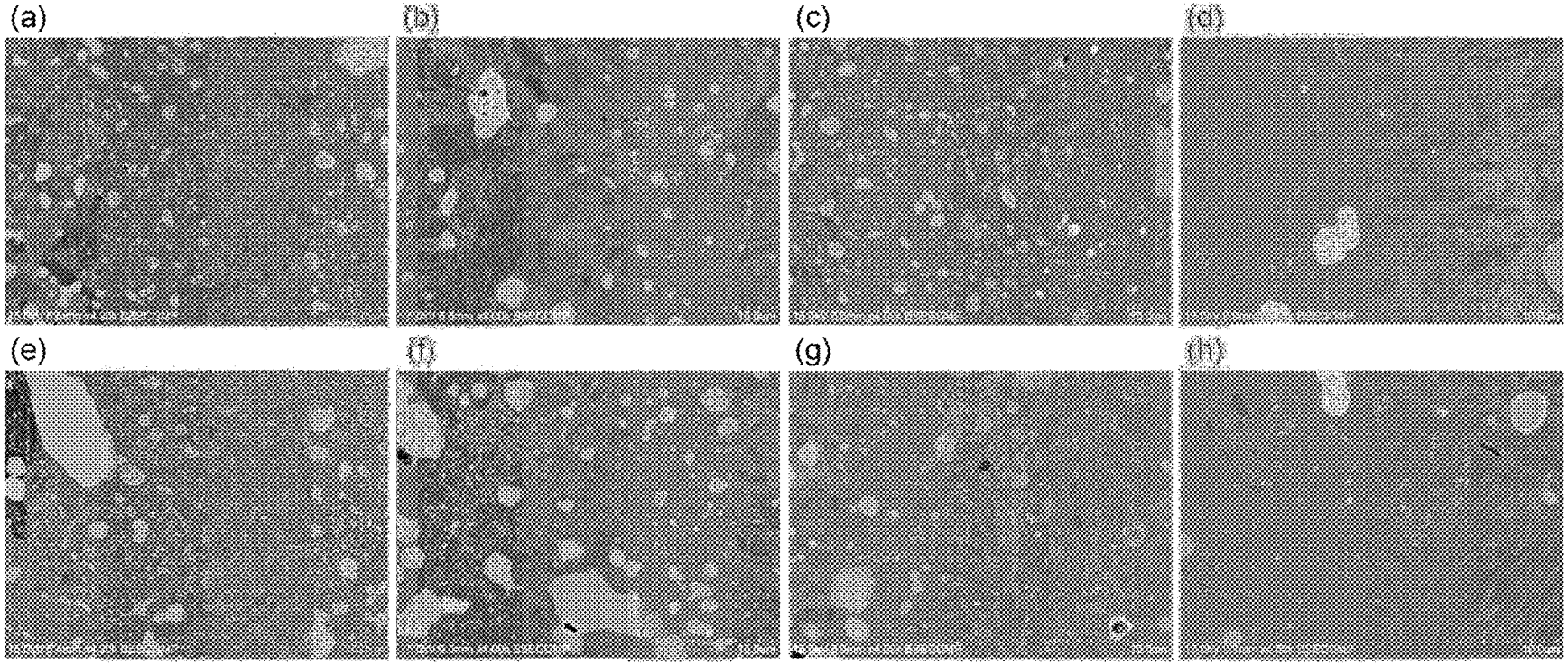
FIG. 16 shows SEM photographs (reflection electron images) of quenched materials of 13Cr shown in FIG. 15 subjected to quenching temperatures of (a) 800° C., (b) 900° C., (c) 1000° C., and (d) 1100° C.; and quenched materials of 16Cr subjected to quenching temperatures of (e) 800° C., (f) 900° C., (g) 1000° C., and (h) 1100° C.

FIGS. 16(*a*) to (*h*) show SEM observation results (reflection electron images) of the samples of 13Cr and 16Cr, respectively. As shown in FIG. 16, $M_{23}C_6$-type carbides were present (corresponding to bright regions in each figure) . Among these carbides, those having a size of several micrometers were thought to be formed by eutectic reactions upon dissolution. Further as shown in FIG. 16, the amount of formed carbides tended to decrease as the quenching temperature increased. This is because the amount of solid solution C in an austenite stable at a high temperature side increases as the temperature increases. Therefore, hardness was highest although the amount of carbides was clearly decreased for the samples of both 13Cr and 16Cr subjected to a quenching temperature of 1100° C. as compared with other samples (refer to FIG. 15). This suggest that hardness of each sample is important not only for the amount or size of formed carbides but also for the hardness of a matrix.

Figure 17:
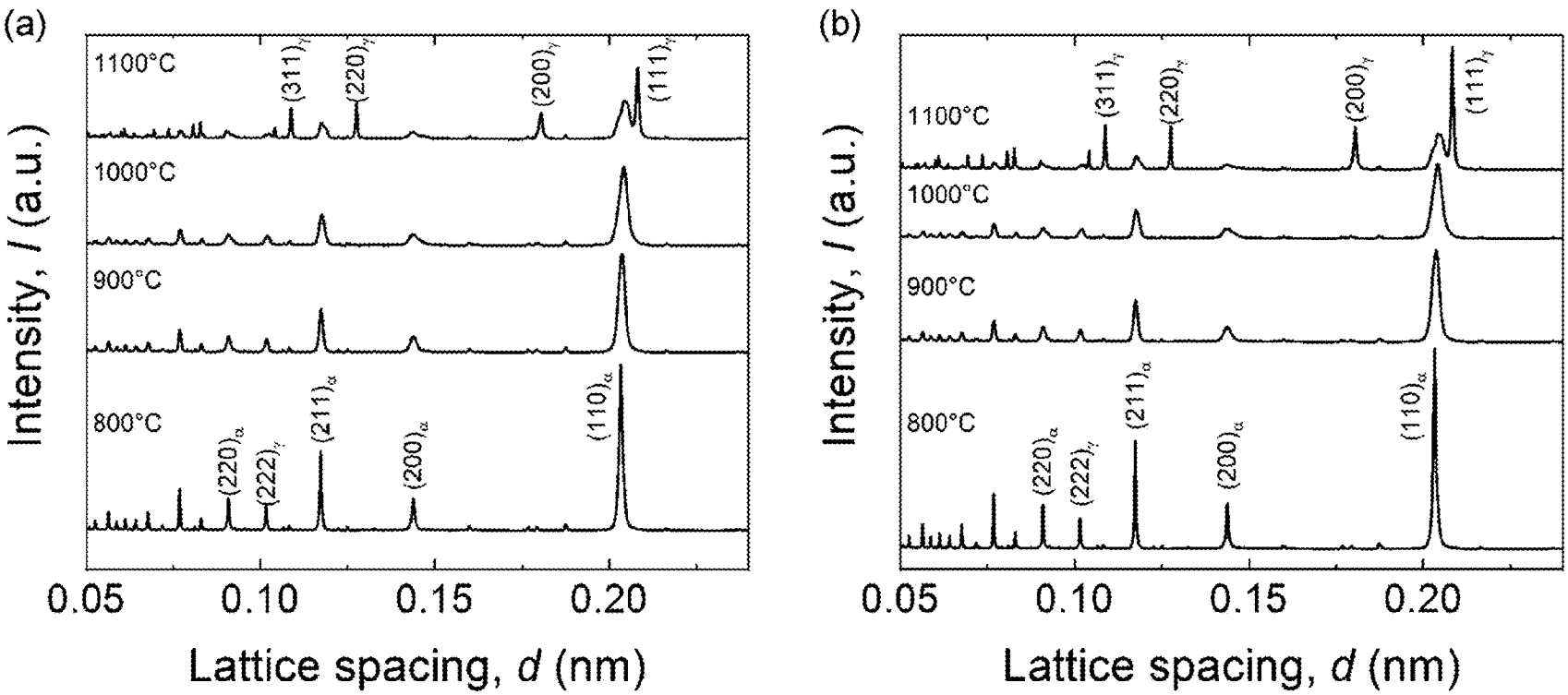
FIG. 17 shows neutron diffraction patterns of (a) the quenched materials of 13Cr treated at the respective quenching temperatures and (b) the quenched materials of 16Cr treated at the respective quenching temperatures.

FIGS. 17(*a*) to (*b*) show neutron diffraction patterns obtained from neutron diffraction measurements on the samples of 13Cr and 16Cr, respectively. As shown in FIG. 17, both 13Cr and 16Cr subjected to a quenching temperature of 800° C. to 1000° C. showed diffraction peaks from a martensite or a ferrite having a BCC structure and diffraction peaks from $M_{23}C_6$-type-carbides. It is noted that the phase boundary of austenite/ferrite is present at around 800° C., and thus the sample subjected to quenching at 800° C. may include ferrite as a BCC phase. On the other hand, a diffraction peak from residual austenite was observed for the sample subjected to quenching from 1100° C. in addition to these. In general, hardness is decreased due to formation of residual austenite. However, high hardness was able to be obtained even in the presence of residual austenite for the respective samples of 13Cr and 16Cr. It is noted that this residual austenite may be transformed into martensite by subzero treatment for further achieving high hardness.

Figure 18:
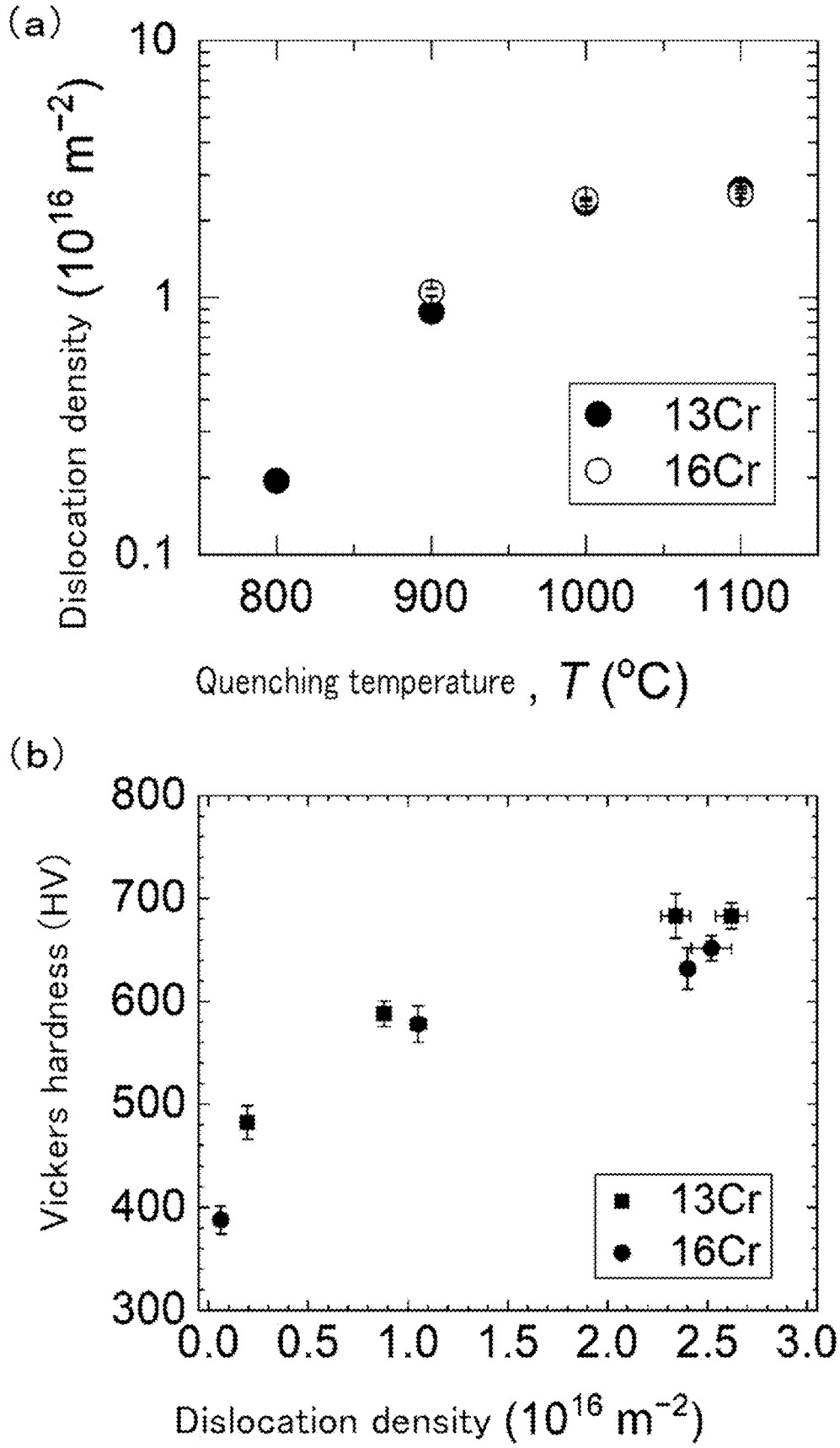
FIG. 18 shows (a) a graph illustrating the relationship between quenching temperatures and dislocation densities for the quenched materials of 13Cr and 16Cr shown in FIG. 15; and (b) a graph illustrating the relationship between Vickers hardnesses and dislocation densities.

FIG. 18(*a*) shows the relationship between quenching temperature and dislocation density obtained from neutron diffraction patterns for the samples of 13Cr and 16Cr, respectively. Further, FIG. 18(*b*) shows the relationship between the Vickers hardness shown in FIG. 15 and the dislocation density. As shown in FIG. 18(*a*), the dislocation density increased as the quenching temperature increased for all of the samples. This is presumably because more C was forcedly dissolved within martensite through the dissolution of carbides, and thus larger lattice strain was generated as the quenching temperature increased, leading to increased dislocation density. As shown in FIG. 18(*b*), the dislocation density of a matrix also showed good correlation with hardness. As understood from FIGS. 18(*a*) and (*b*), hardness was HV 380 or more when the dislocation density was $0.2\times10^{16}$ $m^{-2}$ or more, HV 500 or more when the dislocation density was $0.7\times10^{16}$ $m^{-2}$ or more, and HV 600 or more when the dislocation density was $2.0\times10^{16}$ $m^{-2}$ or more.

Figure 19:
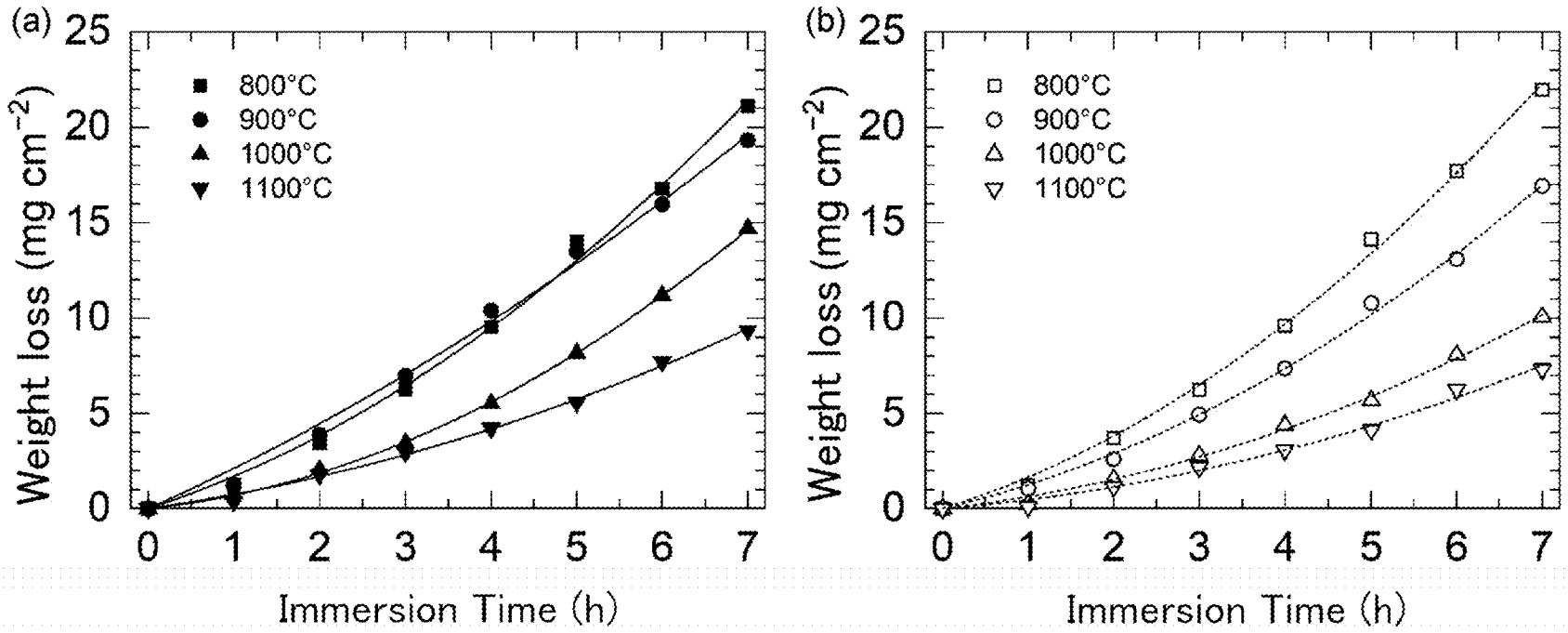
FIG. 19 shows graphs illustrating the time-dependent change of the weight loss with respect to the immersion time into a 0.5 mol/L aqueous solution of sulfuric acid in the corrosion-resistance evaluation tests for the quenched materials of (a) 13Cr and (b) 16Cr shown in FIG. 15.

FIGS. 19(*a*) and (*b*) show the time-dependent change of the weight loss with respect to the immersion time in corrosion-resistance evaluation tests for the samples of 13Cr and 16Cr, respectively. As shown in FIGS. 19(*a*) and (*b*), all the samples showed excellent corrosion resistance, and corrosion resistance was improved as the quenching temperature increased. This is presumably because carbides serving to promote corrosion were more dissolved in austenite during heat treatment as the quenching temperature increased, leading to a decreased amount of carbides being formed finally. Considering the results shown in FIG. 16 and FIG. 18(*a*), high hardness obtained by the presence of carbides is in a trade-off relationship with high hardness obtained by increased dislocation density of a matrix. However, high hardness obtained by the increased dislocation density of a matrix is preferred in view of anti-sulfuric acid corrosion as understood from FIGS. 19(*a*) and (*b*). These can be optimized by controlling structures considering restrictions of applications or manufacturing equipment.

Example 5

Test Samples and Test Method

Test samples were manufactured as follows. First, 30-kg ingots of an Fe-13Cr-3W-1C alloy (unit: mass %) and an Fe-13Cr-3W-1C-2Cu alloy (unit: mass %) were fabricated in a heating furnace. Each of the ingots was subjected to homogenization heat treatment at 1200° C. for 4 hours and then subjected to hot forging twice at 900° C. to 1200° C. to produce a 50-mm square forged material. The forged material was maintained at 850° C. for 2 hours, and then cooling in the furnace, and subsequently subjected to hot rolling at 1180° C. for 2 hours to produce a round bar material having a diameter of 30 mm. The round bar material was further maintained at 850° C. for 2 hours, and then cooled in the furnace. Cylindrical test pieces were cut out from the material after cooling in the furnace, and each sealed into a quartz tube, and then subjected to heat treatment under 3 conditions of 900° C., 1000° C., or 1100° C. for a holding time of 1 hour in a muffle furnace, and then quenched in iced water to obtain test pieces. The compositions of the test samples manufactured are shown in Table 5.

TABLE 5

| Sample | Fe | Cr | W | Cu | C | S | O | N | Si | Mn | Al |
|---|---|---|---|---|---|---|---|---|---|---|---|
| with Cu | Bal. | 12.84 | 2.86 | 1.96 | 0.99 | 0.003 | 0.0014 | 0.0058 | 0.20 | 0.37 | 0.025 |
| without Cu | Bal. | 12.83 | 2.95 | — | 1.00 | 0.003 | 0.0013 | 0.0057 | 0.21 | 0.36 | 0.024 |

Values are expressed in the unit of mass %

Corrosion-resistant evaluation tests were performed on the respective test samples shown in Table 5. For the corrosion-resistance evaluation tests, 10×10×1 $mm^3$ plate-shaped test pieces were cut out from each of the test samples after quenching by wire-electrical discharge machining, and immersed into a 10 mass % aqueous solution of hydrochloric acid at room temperature, and then evaluated for corrosion resistance (anti-hydrochloric acid corrosion) based on the weight loss after a holding time of up to 7 hours. A sample piece to be immersed into an aqueous solution of hydrochloric acid was subjected to surface polishing in advance with emery paper up to #3000. It is noted that hereinafter, the samples from quenched materials of the Fe-13Cr-3W-1C alloy are referred to as "without Cu," and the samples from quenched materials of the Fe-13Cr-3W-1C-2Cu alloy are referred to as "with Cu."

Figure 20:
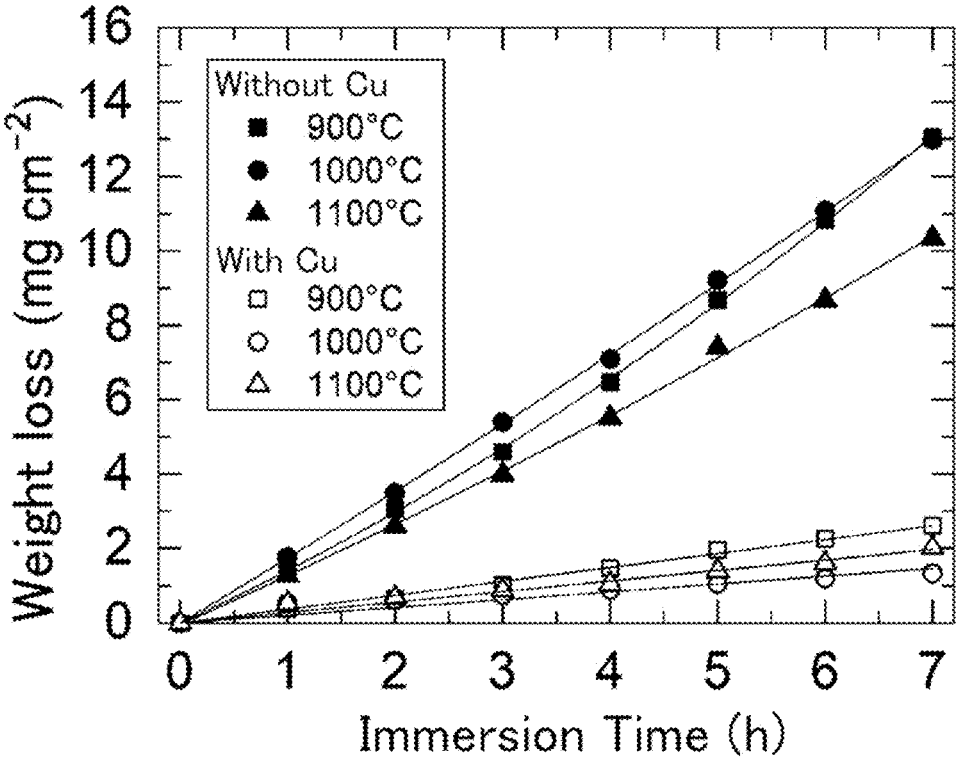
FIG. 20 shows a graph illustrating the time-dependent change of the weight loss with respect to the immersion time into a 10 mass % aqueous solution of hydrochloric acid in the corrosion-resistance evaluation tests for quenched materials of an Fe-13Cr-3W-1C alloy (unit: mass %) and an Fe-13Cr-3W-1C-2Cu alloy (unit: mass %) as the iron-based alloys according to embodiments of the present invention.

FIG. 20 shows the time-dependent change of the weight loss with respect to the immersion time in corrosion-resistance evaluation tests for the samples with Cu and without Cu, respectively. As shown in FIG. 20, all the samples generally had small absolute values of weight loss as compared with the results from the immersion tests in an aqueous solution of sulfuric acid as shown in FIG. 19, and in particular, the samples with Cu showed better corrosion resistance. These results demonstrate that excellent corrosion resistance can be obtained not only in corrosive environments of sulfuric acid but also in corrosive environments of hydrochloric acid. Further, superior corrosion resistance tended to be achieved at a higher quenching temperature as in the results from the immersion tests in an aqueous solution of sulfuric acid shown in FIG. 19.

What is claimed is:

1. An iron-based alloy comprising Cr: 10 to 22 mass %, W: 1 to 12 mass %, C: 0.50 to 2.3 mass %, and Cu: 0.5 to 6 mass %, with the remainder being unavoidable impurities and Fe, and having a structure composed mainly of martensite in which $M_{23}C_6$-type carbides are precipitated, and having a dislocation density of $0.2\times10^{16}$ $m^{-2}$ or more and a Vickers hardness of HV 380 or more.

2. The iron-based alloy according to claim 1, further comprising Ni: 0.5 to 2.5 mass %.

3. The iron-based alloy according to claim 1, further comprising at least one of Al, Mo, and Si in an amount of 1 to 3 mass %.

4. The iron-based alloy according to claim 1, wherein the iron-based alloy has a Vickers hardness of HV 400 or more.

5. The iron-based alloy according to claim 1, wherein the iron-based alloy has a dislocation density of $0.7\times10^{16}$ $m^{-2}$ or more, and a Vickers hardness of HV 500 or more.

6. The iron-based alloy according to claim 1 for use in a plasticizing apparatus or a mold for resin molding.

7. A method of manufacturing an iron-based alloy, the method comprising manufacturing an iron-based alloy having a structure composed mainly of martensite in which $M_{23}C_6$-type carbides are precipitated, and having a dislocation density of $0.2\times10^{16}$ $m^{-2}$ or more and a Vickers hardness of HV 380 or more by heat-treatment at 600° C. to 1250° C. for 0.5 to 24 hours and subsequent rapid cooling of a material prepared by casting or processed after casting a composition of raw materials comprising Cr: 10 to 22 mass %, W: 1 to 12 mass %, C: 0.5 to 2.3 mass %, and Cu: 0.5 to 6 mass %, with the remainder being unavoidable impurities and Fe.

8. The method according to claim 7 for manufacturing an iron-based alloy, wherein the composition of raw materials further comprises Ni: 0.5 to 2.5 mass %.

9. The method according to claim 7 for manufacturing an iron-based alloy, wherein the composition of raw materials further comprises at least one of Al, Mo, and Si in an amount of 1 to 3 mass %.

* * * * *